US009278562B2

(12) United States Patent
Suzuki

(10) Patent No.: US 9,278,562 B2
(45) Date of Patent: Mar. 8, 2016

(54) IMAGE RECORDING DEVICE

(71) Applicant: SEIKO EPSON CORPORATION, Tokyo (JP)

(72) Inventor: Manabu Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/478,752

(22) Filed: Sep. 5, 2014

(65) Prior Publication Data

US 2015/0077468 A1 Mar. 19, 2015

(30) Foreign Application Priority Data

Sep. 19, 2013 (JP) ..... 2013-194043

(51) Int. Cl.

| | |
|---|---|
| ***B41J 23/00*** | (2006.01) |
| ***B41J 25/00*** | (2006.01) |
| ***B41J 2/175*** | (2006.01) |
| ***B41J 2/165*** | (2006.01) |
| *B41J 25/308* | (2006.01) |

(52) U.S. Cl.

CPC ..... *B41J 25/001* (2013.01); *B41J 2/16588* (2013.01); *B41J 2/17523* (2013.01); *B41J 25/3086* (2013.01); *B41J 2202/12* (2013.01)

(58) Field of Classification Search

CPC ..... B41J 2/1752

USPC ..... 347/86, 214, 222

See application file for complete search history.

(56) References Cited

U.S. PATENT DOCUMENTS

| | | | | |
|---|---|---|---|---|
| 6,824,255 | B2 * | 11/2004 | Hino | 347/85 |
| 2002/0113841 | A1 * | 8/2002 | Nishiberi | 347/50 |
| 2003/0025762 | A1 * | 2/2003 | Sturgeon et al. | 347/49 |
| 2005/0078997 | A1 * | 4/2005 | Bingham et al. | 400/679 |
| 2011/0007112 | A1 * | 1/2011 | Takei et al. | 347/37 |
| 2011/0102504 | A1 | 5/2011 | Wanibe | |
| 2012/0249683 | A1 | 10/2012 | Kanemoto et al. | |

FOREIGN PATENT DOCUMENTS

| | | |
|---|---|---|
| JP | 2011-093174 A | 5/2011 |
| JP | 2012-206088 A | 10/2012 |

* cited by examiner

*Primary Examiner* — Shelby Fidler
*Assistant Examiner* — Tracey McMillion
(74) *Attorney, Agent, or Firm* — Global IP Counselors, LLP

(57) ABSTRACT

A first head unit configured to discharge a liquid, a unit holder detachably holding the first unit, and a member configured to move relative to the unit holder are provided. When a trajectory through which the first head unit passes when the first head unit is attached and detached with the unit holder is used as the first trajectory, the member is configured to move between a first position at which the member is positioned relative to the unit holder so as to overlap the first trajectory, and a second position at which the member is positioned relative to the unit holder separated from the first trajectory.

18 Claims, 13 Drawing Sheets

IMAGE RECORDING DEVICE

CROSS-REFERENCE TO RELATED APPLICATIONS

This application claims priority to Japanese Patent Application No. 2013-194043 filed on Sep. 19, 2013. The entire disclosure of Japanese Patent Application No. 2013-194043 is hereby incorporated herein by reference.

BACKGROUND

1. Technical Field

The present invention relates to an image recording device constituted with a head unit for discharging a liquid made to be detachable with a unit holder.

2. Related Art

In Unexamined Patent Publication No. 2011-93174, described is a device for recording an image on a recording medium by discharging ink from a head unit on a recording medium supported on a rotating drum. At this time, alignment of the head unit to the rotating drum is realized by the head unit being held by a carriage. In particular, with Unexamined Patent Publication No. 2011-93174, the carriage holds the head unit so as to be detachable, and it is possible for the operator to insert the head unit in the carriage and to pull out the head unit from the carriage.

To smoothly perform attaching and detaching of the head unit with a unit holder such as a carriage, it is important to not have the head unit that is being attached or detached interfere with the peripheral members. However, with the device noted above, it is necessary to arrange members in the periphery of the head unit. Because of this, when attaching or detaching the head unit with the unit holder, it was difficult to avoid interference between the members provided in the periphery of the unit holder and the head unit.

SUMMARY

This invention was created considering the problem noted above, and an object is to provide technology that makes it possible to avoid interference between members provided in the periphery of the unit holder and the head unit when attaching or detaching the head unit with the unit holder.

To achieve the object noted above, the image recording device of a first mode of this invention is equipped with a first head unit configured to discharge a liquid, a unit holder detachably holding the first head unit, and a member configured to move relative to the unit holder. When a trajectory through which the first head unit passes when the first head unit is attached or detached with the unit holder is used as the first trajectory, the member is configured to move between a first position at which the member is positioned relative to the unit holder so as to overlap the first trajectory, and a second position at which the member is positioned relative to the unit holder so as to be separated from the first trajectory.

With the first mode of the invention (image recording device) constituted in this way, the constitution is such that the member is able to move in relation to the unit holder between the first position and the second position, and while at the first position, the member overlaps the first trajectory through which the first head unit passes when being attached or detached with the unit holder, when it is at the second position, it is separated from the first trajectory. Therefore, during the time that the first head unit is not being attached or detached with the unit holder, it is acceptable as long as the member is positioned at the first position. On the other hand, when the first head unit as being attached or detached with the unit holder, if the member is positioned at the second position, it is possible to perform attachment or detachment of the first head unit to the unit holder while avoiding interference of the first head unit and the member.

It is also possible to constitute the image recording device so as to be equipped with a coupling member that is fixed to the member and the unit holder, and that couples the member and the unit holder such that the member moves relative to the unit holder. The invention can be suitably applied to that constitution as well.

It is also possible to constitute the image recording device so as to be further equipped with a support unit configured to support a recording medium, and a maintenance unit configured to implement maintenance on the first head unit. The unit holder is configured to move together with the member between a third position at which the first head unit discharges the liquid on the recording medium supported on the support unit, a fourth position at which the first head unit undergoes the maintenance by the maintenance unit, and a fifth position at which the first head unit is separated from the support unit and the maintenance unit. The invention can be suitably applied to that constitution as well.

Incidentally, with that constitution, while the first head unit is discharging liquid on the recording medium, or when the first head unit is undergoing maintenance by the maintenance unit, the first head unit cannot be attached or detached with the unit holder in the first place. Therefore, it is not necessary to consider interference of the first head unit and the member accompanying attaching and detaching of the first head unit with the unit holder. On the other hand, when the unit holder is positioned at the fifth position for which the head unit is separated from the support unit and the maintenance unit, since the first head unit is not provided for ink discharge and maintenance, it is possible to attach and detach with the unit holder.

In light of that, it is also possible to constitute the image recording device such that when the first head unit held in the unit holder is positioned at the fifth position, the second position is a position for which the support unit and the maintenance unit do not overlap. With that constitution, it is possible to equip the member positioned at the second position and to attach and detach the first head unit with the unit holder while avoiding interference between the support unit and the maintenance unit.

It is also possible to constitute the image recording device such that the coupling member has a connecting part, a first hinge coupling the unit holder and the connecting part, and a second hinge coupling the connecting part and the member. With this constitution, it is possible to move the member in relation to the unit holder with the freedom of at least the two items including the first hinge and the second hinge. Therefore, it is possible to move the member between the first position and the second position by revolving the member around the unit holder while suppressing rotation of the member.

This is particularly suitable for an image recording device further equipped with a flexible member that is flexible and is connected from the member to the first head unit. This is because it is possible to suppress the flexible member from being extremely bent or the flexible member from being wound onto the member due to rotation of the member.

It is also possible to constitute the image recording device to further be equipped with a second head unit configured to discharge a liquid, and held detachably with the unit holder. When the member is in the first position, the member is separated from the second trajectory through which the second head unit passes when the member is attached or detached with the unit holder, and when in the second position, the member overlaps the second trajectory.

In other words, with the invention, as described above, by positioning the member at the second position, it is possible to perform attaching and detaching of the first head unit with the unit holder while avoiding interference between the first head unit and the member. Incidentally, for the second head unit attached and detached with the unit holder as well, when trying to avoid interference with the member positioned at the second position, it is necessary to separate the second position not only in relation to the first trajectory in which the first head unit is attached and detached, but also in relation to the second trajectory in which the second head unit is attached and detached. Because of that, it is necessary to separate from both head units and to ensure space for the second position, which can cause an increase in the size of the device.

In contrast to this, with the concerned constitution, the trajectory when the second head unit is attached or detached with the unit holder overlaps the member in the second position, but is separated from the member in the first position. Therefore, by positioning the member in the first position, it is possible to perform attaching and detaching of the second head unit with the unit holder while avoiding interference between the second head unit and the member. Thus, it is not necessary to ensure space for the second position up to separation from the second head unit. As a result, it is possible to attach and detach the first and second head units with the unit holder while avoiding interference between the first and second head units and the member, and further possible to make the device more compact.

Various items can be considered as the member. For example, as the member, an example is a liquid supply system configured to supply the liquid to the first head, and constituted movable relative to the unit holder.

To achieve the object noted above, the image recording device of a second mode of this invention is equipped with a first head unit configured to discharge a liquid, a unit holder detachably holding the first head unit, and a member coupled with the unit holder, and configured to move between a first position and a second position. When the member is positioned at the first position, the first head unit is configured not to be attached or detached to the unit holder, and when the member is positioned at the second position, the first head unit is configured to be attached or detached to the unit holder.

With the second mode of the invention (image recording device) constituted in this way, the constitution is such that the member can move in relation to the unit holder between the first position and the second position. Also, when the member is positioned at the first position, the first head unit cannot be attached or detached with the unit holder, and when the member is positioned at the second position, the first head unit can be attached or detached with the unit holder. Therefore, when the first head unit is not being attached or detached with the unit holder, it is acceptable to position the member in the first position. Meanwhile, when the first head unit is being attached or detached with the unit holder, if the member is positioned at the second position, it is possible to perform attachment or detachment of the first head unit with the unit holder while avoiding interference between the first head unit and the member.

BRIEF DESCRIPTION OF THE DRAWINGS

Referring now to the attached drawings which form a part of this original disclosure:

FIG. 13 is a perspective view showing an example of the arrangement of the electrical configuration the printer is equipped with.

DETAILED DESCRIPTION OF EXEMPLARY EMBODIMENTS

Figure 1:
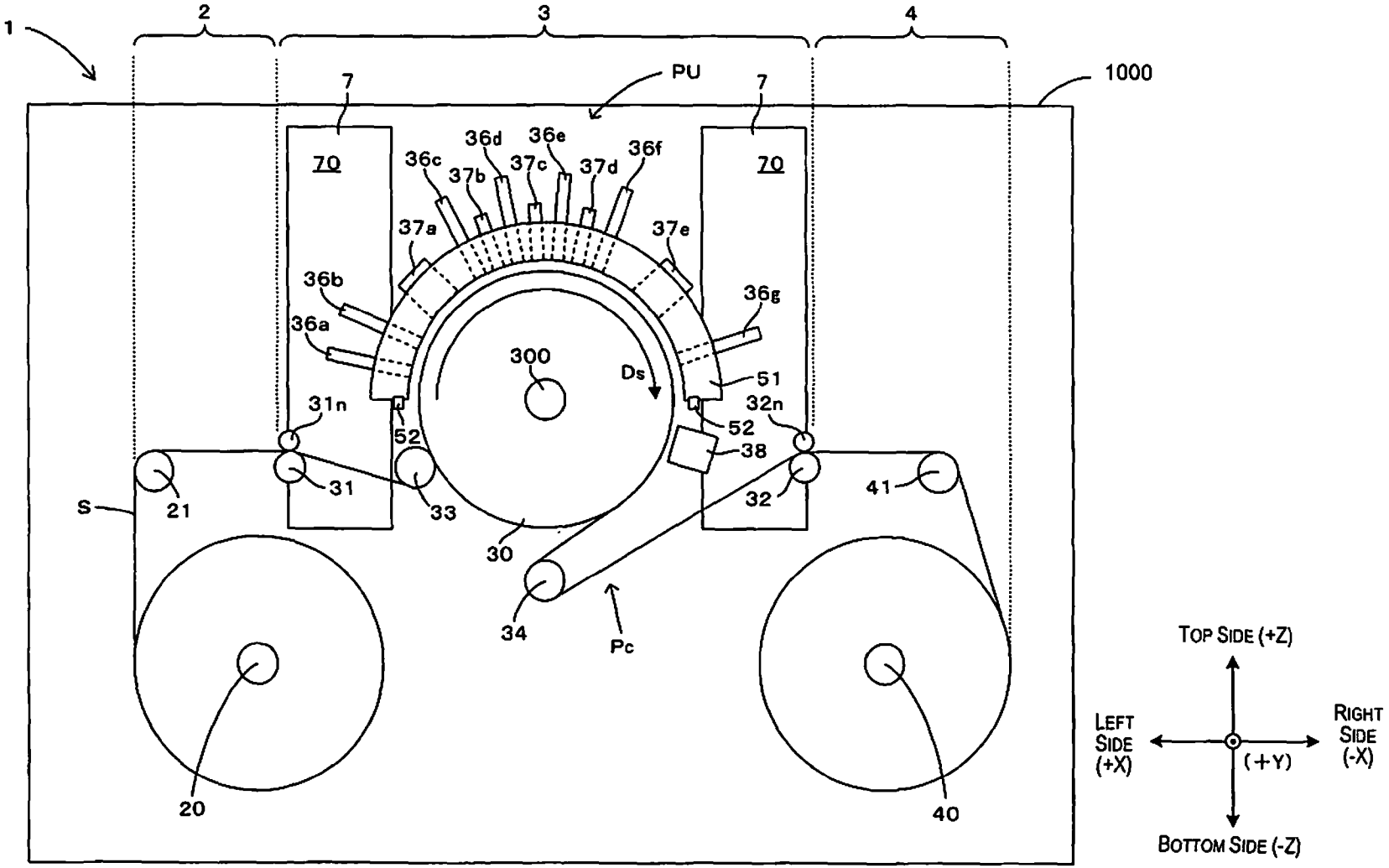
FIG. 1 is a front view showing a typical example of the schematic constitution of a printer to which the present invention can be applied.

FIG. 1 is a front view showing a typical example of the schematic constitution of a printer to which the present invention can be applied. With FIG. 1 and drawings hereafter as necessary, to clarify the arrangement relationship of each of the parts of the device, an XYZ orthogonal coordinate system is displayed corresponding to the left and right direction X, front and back direction Y, and vertical direction Z of a printer 1.

As shown in FIG. 1, with the printer 1, one sheet S (web) for which both ends are wound in roll form on a feed shaft 20 and a take-up shaft 40 is stretched along a conveyance path Pc, and the sheet S undergoes image recording while being conveyed in a conveyance direction Ds facing from the feed shaft 20 to the take-up shaft 40. The sheet S types are roughly divided into paper and film. To list specific examples, for paper, there is high quality paper, cast coated paper, art paper, coated paper and the like, and for film, there is synthetic paper, PET (Polyethylene terephthalate), PP (polypropylene) and the like. Schematically, the printer 1 is equipped with a feed unit 2 (feed area) that feeds the sheet S from the feed shaft 20, a processing unit 3 (processing area) that records an image on the sheet S fed from the feed unit 2, and a take-up unit 4 (take-up area) that takes up the sheet S on which the image is recorded by the processing unit 3 by the take-up shaft 40, wherein these functional units 2, 3, and 4 aligned in the X direction are housed in a housing 1000. With the description hereafter, of the two surfaces of the sheet S, the surface on which the image is recorded is called the front surface, and the reverse side surface to that is called the back surface.

The feed unit 2 has the feed shaft 20 on which the end of the sheet S is wound, and a driven roller 21 that winds the sheet S pulled from the feed shaft 20. In a state with the front surface of the sheet S facing the outside, the feed shaft 20 winds and supports the sheet S. Also, by rotating the feed shaft 20 clockwise at the paper surface in FIG. 1, the sheet S wound on the feed shaft 20 is fed via the driven roller 21 to the processing unit 3. Incidentally, the sheet S is wound on the feed shaft 20 via a core tube (not illustrated) that can be attached and detached with the feed shaft 20. Therefore, when the sheet S of the feed shaft 20 is used up, a new core tube on which the sheet S is wound in roll form is mounted on the feed shaft 20, making it possible to replace the sheet S of the feed shaft 20.

The processing unit 3 performs processing as appropriate using a process unit PU arranged along the outer circumference surface of a rotating drum 30 while supporting the sheet S fed from the feed unit 2 on the rotating drum 30, and prints an image on the sheet S. With this processing unit 3, a front drive roller 31 and a rear drive roller 32 are provided at both sides of the rotating drum 30, the sheet S conveyed from the front drive roller 31 to the rear drive roller 32 is supported on the rotating drum 30, and it undergoes image printing.

The front drive roller 31 has a plurality of minute projections formed by thermal spraying on the outer circumference surface, and the sheet S fed from the feed unit 2 is wound from the back surface side. Also, by the front drive roller 31 rotating clockwise on the paper surface of FIG. 1, the sheet S fed from the feed unit 2 is conveyed to the downstream side of the conveyance path Pc. A nip roller 31*n* is provided on the front drive roller 31. This nip roller 31*n* abuts the front surface of the sheet S in a state biased to the front drive roller 31 side, and the sheet S is sandwiched between it and the front drive roller 31. By doing this, frictional force is ensured between the front drive roller 31 and the sheet S, and it is possible to reliably perform conveying of the sheet S by the front drive roller 31.

The rotating drum 30 is a cylindrical shaped drum having a center line parallel to the Y direction, and the sheet S is wound on its outer circumference surface. Furthermore, the rotating drum 30 has a rotating shaft 300 that extends in the axial direction through the center line of the cylindrical shape. The rotating shaft 300 is supported to be able to rotate by a support mechanism that is not illustrated, and the rotating drum 30 rotates with the rotating shaft 300 as the center.

On the outer circumference surface of this kind of rotating drum 30, the sheet S conveyed from the front drive roller 31 to the rear drive roller 32 is wound from the back surface side. Also, the rotating drum 30 receives friction force with the sheet S, and the sheet S is supported from the back surface side while doing following rotation in the conveyance direction Ds of the sheet S. Incidentally, with the processing unit 3, driven rollers 33 and 34 that fold back the sheet S are provided at both sides of the winding part onto the rotating drum 30. Of these, the driven roller 33 winds the front surface of the sheet S between the front drive roller 31 and the rotating drum 30, and folds back the sheet S. Meanwhile, the driven roller 34 winds the front surface of the sheet S between the rotating drum 30 and the rear drive roller 32, and folds back the sheet S. In this way, by folding back the sheet S respectively at the upstream and downstream side of the conveyance direction Ds in relation to the rotating drum 30, it is possible to ensure a long winding part of the sheet S onto the rotating drum 30.

The rear drive roller 32 has a plurality of minute projections formed using thermal spraying on the outer circumference surface, and the sheet S conveyed via the drive roller 34 from the rotating drum 30 is wound from the back surface side. Also, by the rear drive roller 32 rotating clockwise on the paper surface in FIG. 1, the sheet S is conveyed to the take-up unit 4. A nip roller 32*n* is provided on the rear drive roller 32. This nip roller 32*n* abuts the front surface of the sheet S in a state biased to the rear drive roller 32 side, and the sheet S is sandwiched between it and the rear drive roller 32. By doing this, friction force between the rear drive roller 32 and the sheet S is ensured, and it is possible to reliably perform conveyance of the sheet S by the rear drive roller 32.

In this way, the sheet S conveyed from the front drive roller 31 to the rear drive roller 32 is supported on the outer circumference surface of the rotating drum 30. Also, with the processing unit 3, the process unit PU is provided for printing a color image on the front surface of the sheet S supported on the rotating drum 30. This process unit PU has a constitution with which head units 36*a* to 36*g*, UV irradiators 37*a* to 37*e*, and an ink supply system 7 are supported by a carriage 51.

The seven head units 36*a* to 36*g* aligned in sequence in the conveyance direction Ds correspond to white, white, yellow, cyan, magenta, black, and clear (transparent), and discharge ink of corresponding colors from nozzles using the inkjet method. Each head unit 36*a* to 36*g* has a constitution with a discharge head 360 described later using FIG. 2 attached to the tip. With the discharge head 360 (FIG. 2) of the head units 36*a* to 36*g*, nozzle rows are provided for which a plurality of nozzles are arrayed across the width of the sheet S in the Y direction, and ink is discharged from each nozzle of the nozzle row. These seven head units 36*a* to 36*g* are arranged in radiating form from the rotating shaft 300 of the rotating drum 30, and are aligned along the outer circumference surface of the rotating drum 30. Also, each head unit 36*a* to 36*g* is aligned in relation to the rotating drum 30 by the carriage 51, and faces opposite the rotating drum 30 with a slight clearance (paper gap) opened. By doing this, each head unit 36*a* to 36*g* faces opposite the front surface of the sheet S wound on the rotating drum 30 with a designated paper gap opened. In this way, in a state with a paper gap regulated by the carriage 51, by each head unit 36*a* to 36*g* discharging ink, ink impacts desired positions on the front surface of the sheet S, and a color image is formed on the front surface of the sheet S.

Incidentally, the head units 36*a* and 36*b* that discharge white ink are used for forming a white background on the sheet S when printing an image on a transparent sheet S. In specific terms, the head units 36*a* and 36*b* form a background by discharging white ink so as to completely fill in the entire surface of the area subject to image formation. Also, the head units 36*c* to 36*f* that discharge yellow, cyan, magenta, and black ink form a color image overlapping the white background. Also, the head unit 36*g* discharges clear ink overlapping the color image, so the color image is covered by clear ink. This gives a qualitative feel such as a glossy feel or matte feel or the like to the color image.

As the ink used with the head units 36*a* to 36*g*, UV (ultraviolet) ink that is cured by the irradiation of ultraviolet rays (light) (photocurable ink) is used. In light of that, to cure the ink and fix the ink on the sheet S, UV irradiators 37*a* to 37*e* are provided. This ink curing is executed with use divided between main curing and temporary curing. Here, main curing is the process of curing ink to the degree that wetting and spreading of the ink is stopped by irradiating ultraviolet rays of a relatively strong irradiation strength on the ink, and temporary curing is the process of curing ink to the degree that the wetting and spreading mode of the ink is sufficiently slow compared to when ultraviolet rays are not irradiated, by irradiating ultraviolet rays of relatively weak irradiation strength on the ink.

In specific terms, the UV irradiator 37*a* for main curing is arranged between the white head unit 36*b* and the cyan head unit 36*c*. Therefore, the white background formed by the head units 36*a* and 36*b* receive ultraviolet rays from the UV irradiator 37*a* to undergo main curing before ink from the head units 36*c* to 36*f* is overlapped. The UV irradiators 37*b* to 37*d* for temporary curing are arranged between the yellow, cyan, magenta, and black head units 36*c* to 36*f*. Therefore, the ink discharged respectively by the head units 36*c* to 36*e* receive ultraviolet rays from the UV irradiators 37*b* to 37*d* and undergo temporary curing before ink from the head units 36*d* to 36*f* of the downstream side of the conveyance direction Ds is overlapped. By doing this, the occurrence of color mixing, which is the mixing of inks discharged respectively from the head units 36*c* to 36*e*, is suppressed. The UV irradiator 37*e* for main curing is arranged between the black head unit 36*f* and the clear head unit 36*g*. Therefore, the color image formed by the head units 36*b* to 36*f* receive ultraviolet rays from the UV irradiator 37*e* and undergo main curing before ink from the head unit 36*g* is overlapped.

Also, two ink supply systems 7 are aligned in the X direction and attached on the back side (+Y side) of the carriage 51. The left side (+X side) ink supply system 7 has a constitution with which there is a mechanism for supplying white, white, yellow, and cyan ink (ink flow control mechanism) for each color and is housed in a housing 70, and supplies ink of colors corresponding to the four respective head units 36*a*, 36*b*, 36*c*, and 36*d*. The right side (−X) ink supply system 7 has a constitution for which there is a mechanism for supplying magenta, black, and clear ink (ink flow control mechanism) for each color and is housed in the housing 70, and supplies ink of colors corresponding to the three respective head units 36*e*, 36*f*, and 36*g*.

Figure 2:
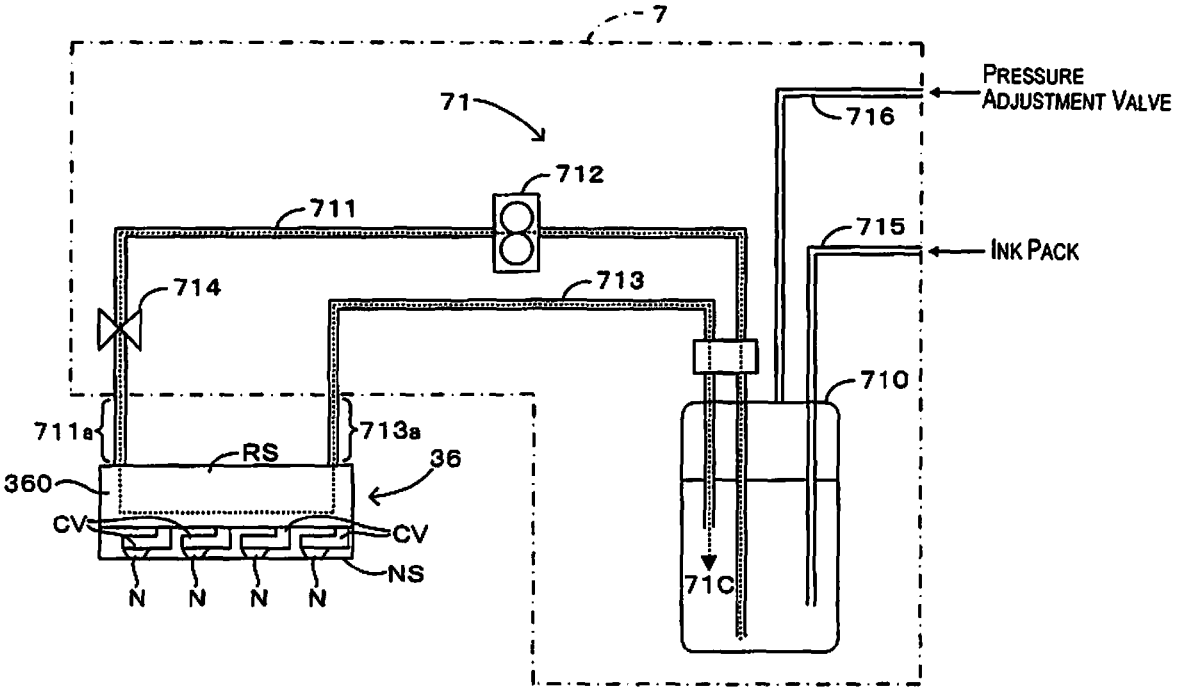
FIG. 2 is a drawing showing a typical example of the ink supply system and the discharge head of the head unit.

Here, we will use FIG. 2 to give a detailed description of the constitution by which the ink supply system 7 supplies ink to the head units. FIG. 2 is a block diagram showing a typical example of the ink supply system 7 and the discharge head of the head unit. The ink supply system 7 has an ink flow control mechanism 71 for each color, but since the constitution of the ink flow control mechanism 71 is the same for each color, we will show as a typical example only one ink flow control mechanism 71 in this drawing. Also, the constitution of the discharge head 360 equipped at the respective tips of the head units 36*a* to 36*g* are also the same for each color, so only one discharge head 360 is shown as a typical example in this drawing.

The discharge head 360 has nozzles N that open to a nozzle forming surface NS, a reservoir RS in which ink is temporarily stored, and a cavity CV which allows communication between the nozzles N and the reservoir RS, and ink is supplied to the nozzles N from the reservoir RS via the cavity CV. Also, by the cavity CV adding pressure to the ink, ink is discharged from the nozzles N.

Meanwhile, the ink flow control mechanism 71 built into the ink supply system 7 circulates ink between a tank 710 for storing ink (sub tank) and the discharge head 360. In specific terms, in addition to the tank 710, the ink flow control mechanism 71 also has a supply flow path 711 (supply piping) that connects the reservoir RS and the tank 710, a circulating pump 712 provided on the supply flow path 711, and a recovery flow path 713 (recovery piping) that connects the reservoir RS and the tank 710. In this way, with the tank 710, the supply flow path 711, the reservoir RS, the recovery flow path 713, and the tank 710 in this sequence, a circulation path 71C in which ink flows is formed, and by the circulating pump 712 rotating in the forward direction, the ink circulates in the circulation path 71C. In other words, by the circulating pump 712 rotating forward, it is possible to supply ink from the tank 710 to the reservoir RS via the supply flow path 711 (forward path), and possible to recover ink from the reservoir RS to the tank 710 via the recovery flow path 713 (return path).

Of the supply flow path 711, from leaving the housing 70 of the ink supply system 7 until reaching the head unit 36 is constituted using flexible piping 711*a*. Also, of the recovery flow path 713, from leaving the head unit 36 until reaching the housing 70 of the supply system 7 is constituted using flexible piping 713*a*.

Also, the ink flow control mechanism 71 has a valve 714 that opens and closes the supply flow path 711. This valve 714 is provided midway from the circulating pump 712 until reaching the reservoir RS along the circulation path 71C. Therefore, by opening the valve 714, it is possible to execute supplying of ink to the reservoir RS from the tank 710, and by closing the valve 714, it is possible to stop the supplying of ink from the tank 710 to the reservoir RS.

Furthermore, the ink flow control mechanism 71 has an ink supply path 715 (ink supply piping) for supplying ink to the tank 710 and a pressure adjustment flow path 716 (pressure adjustment piping) for adjusting the pressure inside the tank 710. The ink supply path 715 is connected to an ink cartridge or an ink pack, and ink is supplied from these to the tank 710. Incidentally, the ink supplied to the tank 710 has a viscosity of for example approximately 15 mPa·s at 28 to 40 degrees. Also, the pressure adjustment flow path 716 is connected to a pump, and the pressure inside the tank 710 is adjusted by rotating this pump. By doing this, the pressure of the tank 710 can be adjusted respectively to negative pressure, atmospheric pressure, and positive pressure.

We will continue the description while returning to FIG. 1. As described above, the process unit PU is constituted with seven head units 36*a* to 36*g*, five UV irradiators 37*a* to 37*e*, and two ink supply systems 7 loaded in the carriage 51. Guide rails 52 are arranged extending in the Y direction respectively facing opposite both end parts of the X direction (conveyance direction Ds) of the carriage 51, and the carriage 51 is stretched across the two rails 52 from the X direction. Therefore, the carriage 51 is able to move in the Y direction on the guide rails 52 along with the head units 36*a* to 36*g*, the UV irradiators 37*a* to 37*e*, and the ink supply systems 7. In specific terms, as described later using FIG. 3, the process unit PU moves as appropriate between printing position Ta, automatic maintenance position Tb, and manual operation maintenance position Tc aligned in the Y direction.

Also, with the processing unit 3, the UV irradiator 38 for main curing is provided at the downstream side of the conveyance direction Ds on the head unit 36*g*. Therefore, the clear ink discharged overlapping the color image by the head unit 36*g* undergoes main curing by receiving ultraviolet rays from the UV irradiator 38. The UV irradiator 38 is not installed in the carriage 51.

The sheet S on which a color image is formed by the processing unit 3 is conveyed to the take-up unit 4 by the rear drive roller 32. In addition to the take-up shaft 40 on which the end of the sheet S is wound, this take-up unit 4 has a driven roller 41 on which the sheet S is wound from the back surface side between the take-up shaft 40 and the rear drive roller 32. In a state with the front surface of the sheet S facing the outside, the take-up shaft 40 winds up and supports the end of the sheet S. In other words, when the take-up shaft 40 rotates clockwise on the paper surface in FIG. 1, the sheet S conveyed from the rear drive roller 32 is wound onto the take-up shaft 40 via the driven roller 41. Incidentally, the sheet S is wound onto the take-up shaft 40 via a core tube (not illustrated) that can be attached and detached with the take-up shaft 40. Therefore, it is possible to remove the sheet S for each core tube when the sheet S wound onto the take-up shaft 40 becomes full.

Figure 3:
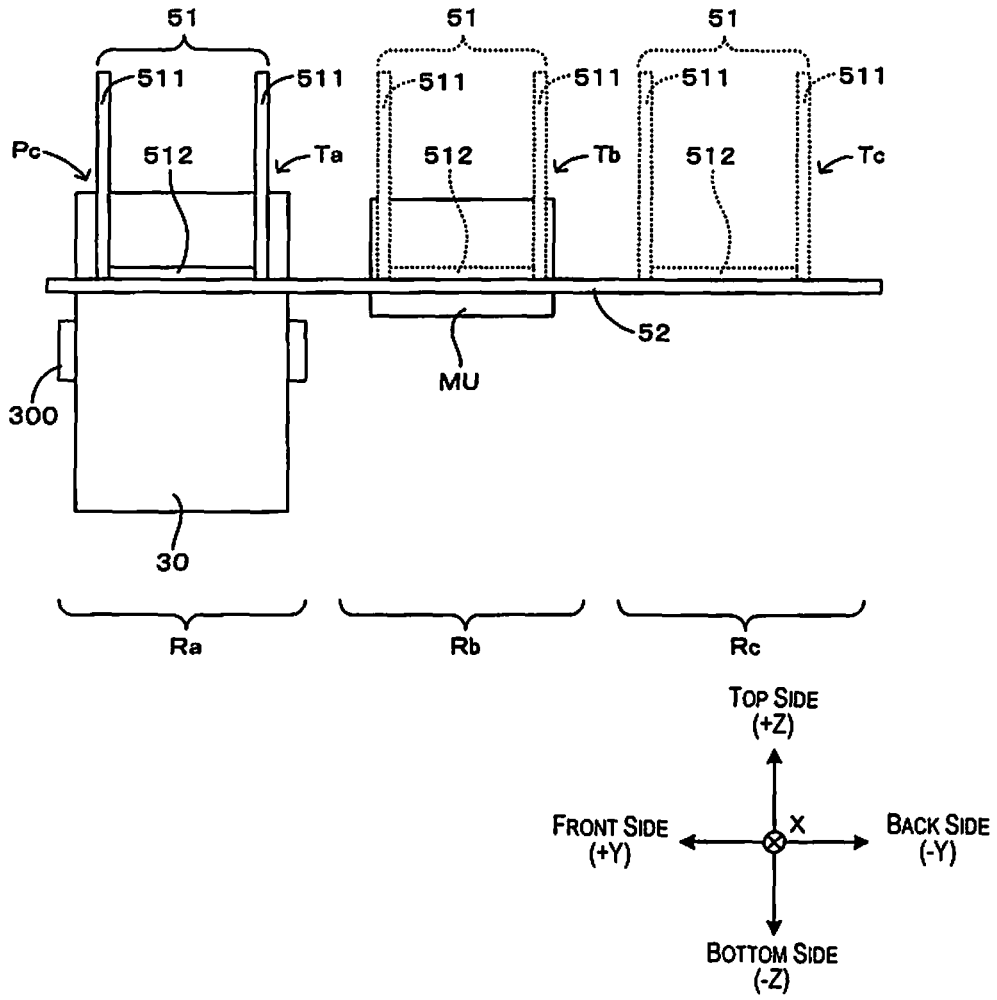
FIG. 3 is a side view showing a typical example of the schematic constitution of the printer shown in FIG. 1.

Above is a summary of the constitution of the printer 1 with a front view. Following, we will describe a summary of the constitution of the printer 1 with a side view using FIG. 3. Here, FIG. 3 is a side view showing a typical example of the schematic constitution of the printer 1 shown in FIG. 1. As shown in FIG. 3, the carriage 51 is constituted by two arc shaped support frames 511 aligned in the Y direction, and a base frame 512 connecting the bottom edges of the two support frames 511 provided respectively at both ends of the arc shaped support frames 511. Also, the head units 36*a* to 36*g* and the UV irradiators 37*a* to 37*e* described above are sandwiched and held from the Y direction between the two support frames 511, and the ink supply system 7 is attached and held at the back side (−Y side) support frame 511. In FIG. 3, the head units 36*a* to 36*g*, the UV irradiators 37*a* to 37*e*, and the ink supply system 7 are omitted from the illustration, and of the printing position Ta, the automatic maintenance position Tb, and the manual operation maintenance position Tc at which the carriage 51 is selectively aligned, the carriage 51 when positioned at the printing position Ta is shown by a solid line, and the carriage 51 when positioned at the automatic maintenance position Tb or the manual operation maintenance position Tc is shown by a dotted line.

Inside a housing member 1000 of the printer 1, a printing area Ra, an automatic maintenance area Rb, and a manual operation maintenance area Rc are aligned in the Y direction. With the printing area Ra, each functional unit shown in FIG. 1 including the feed unit 2, the processing unit 3, and the take-up unit 4 are housed, and printing is performed on the sheet S. The printing position Ta, the automatic maintenance position Tb, and the manual operation maintenance position Tc are provided respectively in the printing area Ra, the automatic maintenance area Rb, and the manual operation maintenance area Rc. Also, by moving the carriage 51 along two guide rails 52 at left and right provided extending across the positions Ta, Tb, and Tc aligned in the Y direction, the carriage 51 can be aligned alternatively at the positions Ta, Tb, and Tc. When the carriage 51 is aligned at the printing position Ta, the head units 36*a* to 36*g* and the UV irradiators 37*a* to 37*e* held in the carriage 51 face opposite the conveyance path Pc of the sheet S. Therefore, it is possible to perform discharging of ink from the head units 36*a* to 36*e* or irradiating of ultraviolet rays from the UV irradiators 37*a* to 37*e*, and to perform printing of an image on the sheet S conveyed along the conveyance path Pc. Also, when the carriage 51 is aligned at the automatic maintenance position Tb or the manual operation maintenance position Tc, the head units 36*a* to 36*g* and the UV irradiators 37*a* to 37*e* held in the carriage 51 are retracted from the conveyance path Pc of the sheet S to the Y direction. Therefore, it is possible to perform the desired maintenance while preventing interference with the conveyance path Pc sheet S.

A maintenance unit MU is arranged beneath the automatic maintenance position Tb, and in a state with the carriage 51 aligned at the automatic maintenance position Tb, the head units 36*a* to 36*g* and the UV irradiators 37*a* to 37*e* face opposite the maintenance unit MU from above. The maintenance unit MU has a semicircular tube shape for which the circumference part faces upward, and in a state with the arc seen from the Y direction matching or slightly positioned inward in relation to the rotating drum 30, it is adjacent to the rotating drum 30 from the Y direction. Also, the maintenance unit MU performs various types of maintenance such as capping, cleaning and wiping on the head units 36*a* to 36*g* held in the carriage 51 positioned at the maintenance position Tb.

Capping is the operation of covering the surface at which the nozzles N open on the head units 36*a* to 36*g* (nozzle forming surface NS) with a cap that the maintenance unit MU is equipped with. By doing this capping, it is possible to inhibit an increase in the viscosity of the ink inside the nozzles N of the head units 36*a* to 36*g*. Also, cleaning is an operation by which in a state with the head units 36*a* to 36*g* capped, the maintenance unit MU generates negative pressure inside the cap, and forcibly exhausts ink from the nozzles N. By doing this cleaning, it is possible to remove from the nozzles ink for which the viscosity has increased, air bubbles in the ink or the like. Wiping is the operation of wiping the nozzle forming surface NS of the head units 36*a* to 36*g* using a wiper that the maintenance unit MU is equipped with. By doing this wiping, it is possible to wipe away ink from the nozzle forming surfaces NS of the head units 36*a* to 36*g*.

In a state with beneath the manual operation maintenance position Tc open, and the carriage 51 aligned at the manual operation maintenance position Tc, a manual operation space is ensured below the head units 36*a* to 36*g* and the UV irradiators 37*a* to 37*e*. Therefore, the operator is able to execute maintenance manually such as wiping of the ink or the like on the head units 36*a* to 36*g* and UV irradiators 37*a* to 37*e* held in the carriage 51 aligned at the manual operation maintenance position Tc.

Figure 4:
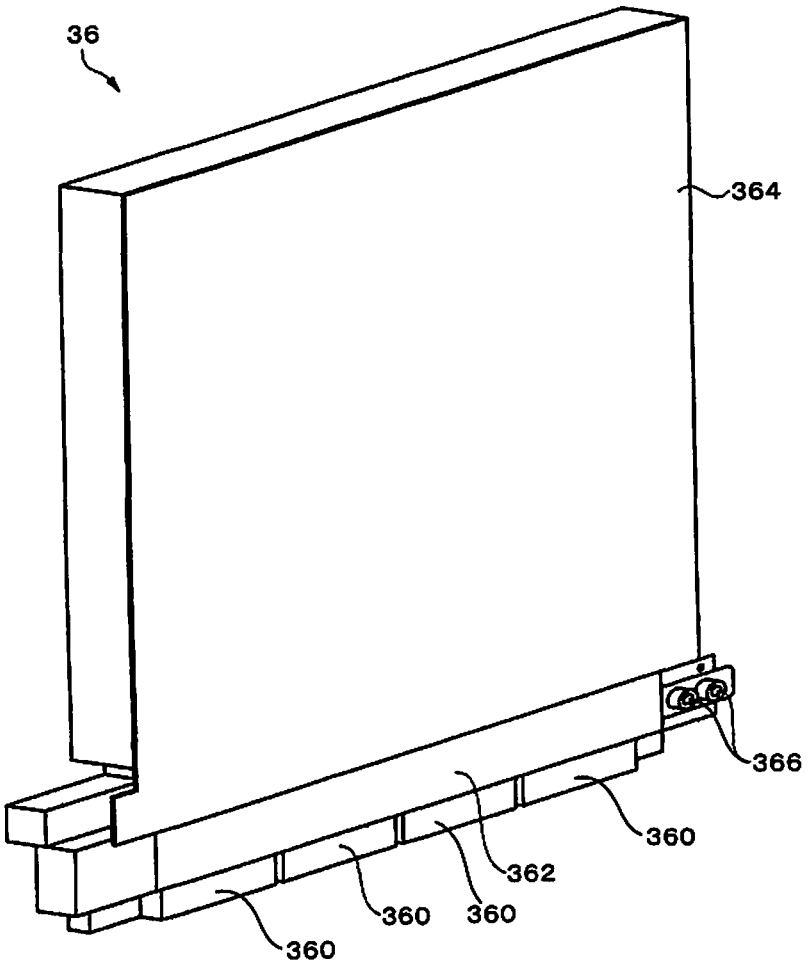
FIG. 4 is a perspective view showing a typical example of the external constitution of the head unit.
Figure 5:
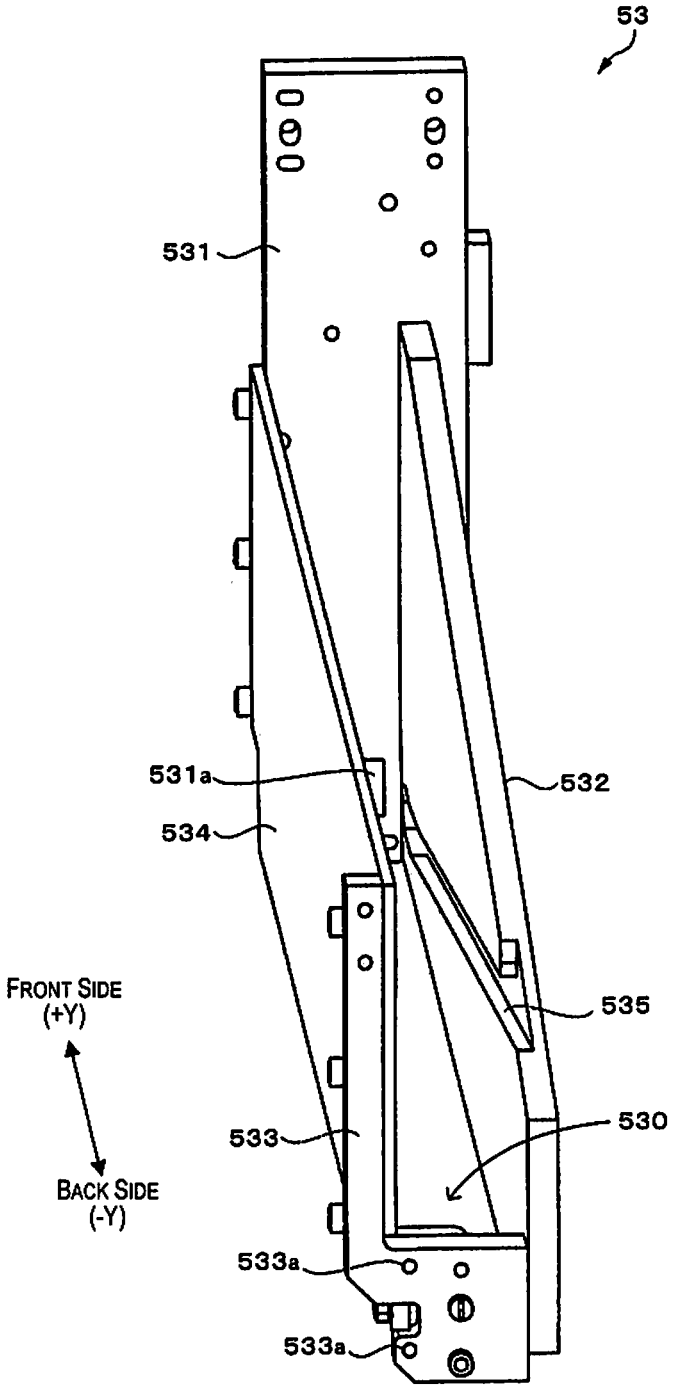
FIG. 5 is a perspective view showing a typical example of the schematic constitution of the unit mounting part that the carriage has.

Incidentally, to make manual maintenance of the head units 36*a* to 36*g* more efficient or the like, each respective head unit 36*a* to 36*g* is held to be attachable and detachable with the carriage 51. Following, using FIG. 4 to FIGS. 6A-6D, we will give a detailed description of the mechanism that holds the head units 36*a* to 36*g* so as to be detachable. FIG. 4 is a perspective view showing a typical example of the external constitution of the head unit. FIG. 5 is a perspective view showing a typical example of the schematic constitution of the unit mounting part that the carriage 51 has. FIGS. 6A-6D is a side view showing a typical example of the operation of attaching or detaching the head unit with the unit mounting part of the carriage 51. The unit mounting part 52 is provided corresponding respectively to the head units 36*a* to 36*g*, and seven unit mounting parts 53 are fixed to the carriage 51, but the constitution of each unit mounting part 53 is the same, so here, we will describe a single unit mounting part 53. Also, the constitution of the head units 36*a* to 36*g* are also the same, so here, we will describe a single head unit noted with a reference number 36.

As shown in FIG. 4, the head unit 36 has a head plate 362 which is a rigid member made of metal. The head plate 362 has a rectangular shape extending in rod form, a plurality of discharge heads 360 are aligned in the lengthwise direction of the head plate 362, and are attached so as to be detachable with one surface of the head plate 362 (lower surface in FIG. 4). Also, on the other surface of the head plate 362 (upper surface in FIG. 4), a rectangular unit cover 364 is attached. A head control circuit for controlling each discharge head, or a manifold for distributing ink supplied from the ink flow control mechanism 71 to each discharge head 360 is housed in this unit cover 364. Furthermore, at one end of the lengthwise direction of the head plate 362, two engaging projections 366 projecting facing toward the side are aligned in the lengthwise direction of the head plate 362. As described later, the outer circumference surface of these engaging projections 366 have the role of guiding mounting of the head unit 36 on the unit mounting part 53 (FIG. 5) of the carriage 51.

As shown in FIG. 5, the unit mounting part 53 is equipped with a schematic constitution with a front plate 531, a side plate 532, a rear plate 533, and an auxiliary plate 534, surrounded by the space in which the head unit is mounted, and an opening 530 facing downward in FIG. 5 is defined by these plates 531 to 534. The front plate 531 is attached with the flat surface of the front plate 531 facing the Y direction on the front side support frame 511 of the two support frames 511 constituting the carriage 51. The side plate 532 and the auxiliary plate 534 are attached to the front plate 531 while mutually facing opposite in the direction orthogonal to the Y direction, and are provided extending to the back side of the Y direction (−Y side) from the front plate 531. Also, the rear plate 533 is attached to the auxiliary plate 534 while facing opposite to the front plate 531 from the back side of the Y direction (−Y side).

As shown in FIG. 5 and FIGS. 6A-6D, an engaging part 531*a* that engages with the front end (+Y side end) of the head plate 362 of the head unit 36 mounted in the unit mounting part 53 is provided on the front plate 531. Also, an engaging part 533*a* that engages with the back end (−Y side end) of the head plate 362 of the head unit 36 mounted in the unit mounting part 53 is provided on the rear plate 533. Furthermore, on the inside surface (surface of the auxiliary plate 534 side) of the side plate 532, a guide groove 535 is provided extending in the Y direction. The guide groove 535 has a tilted part 535*a* approaching the opening 530 as it faces the front side (+Y side) of the Y direction, and a parallel part 535*b* that is parallel in the Y direction extending to the front side (+Y direction side) of the Y direction from the front end (+Y side end) of the tilted part 535*a*. Also, an opening 535*c* is provided opening at the back side (−Y direction side) of the Y direction on the back end (−Y side end) of the tilted part 535*a* of the guide groove 535.

Figure 6A:
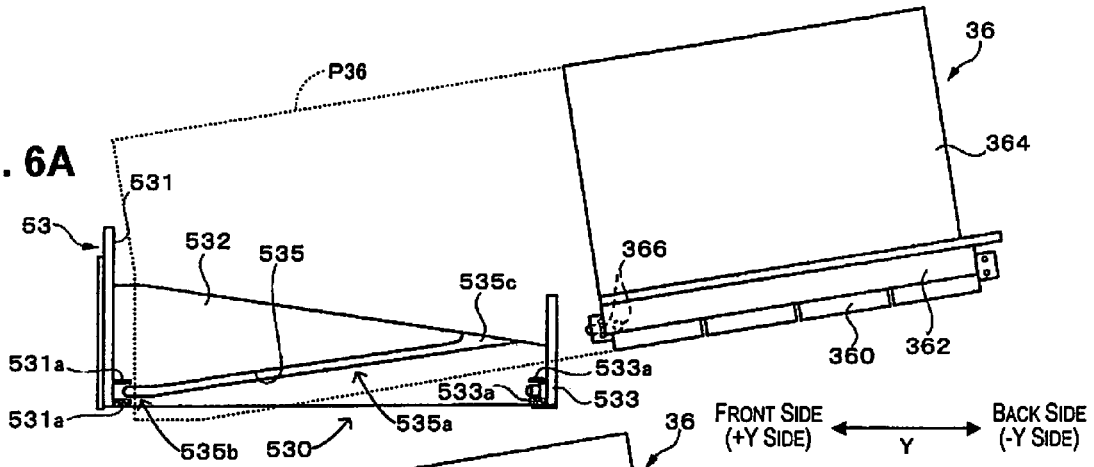
FIG. 6A is a side view showing a typical example of the attaching and detaching operation of the head unit.
Figure 6B:
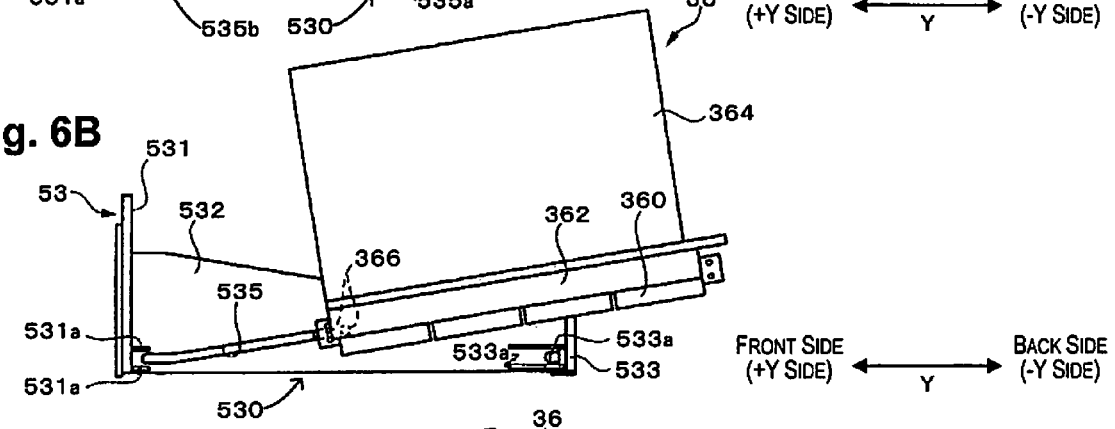
FIG. 6B is the side view showing the typical example of the attaching and detaching operation of the head unit.
Figure 6C:
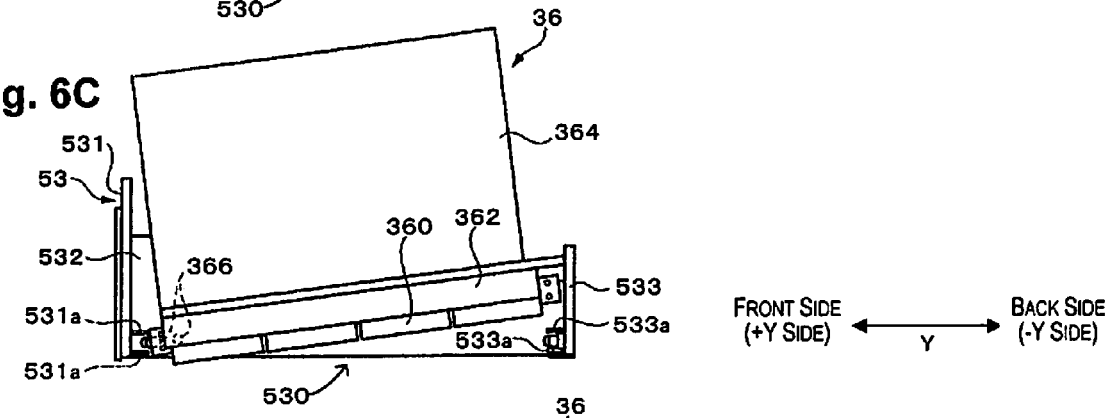
FIG. 6C is the side view showing the typical example of the attaching and detaching operation of the head unit.
Figure 6D:
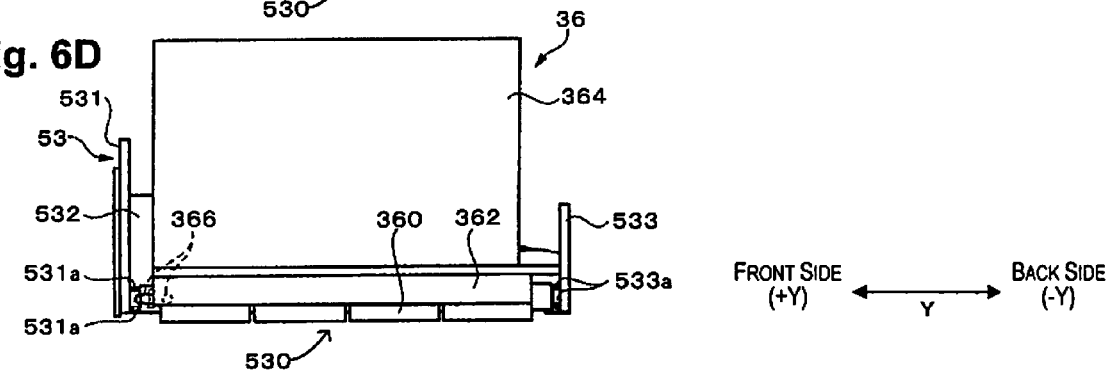
FIG. 6D is the side view showing the typical example of the attaching and detaching operation of the head unit.

Using FIGS. 6A-6D, we will describe an example of the operation of mounting the head unit 36 in the unit mounting part 53. The operation in FIGS. 6A-6D is executed manually by the operator. First, as shown in FIG. 6A, while holding the head unit 36 tilted so that the lengthwise direction of the head plate 362 is roughly parallel to the tilted part 535*a* of the guide groove 535, the engaging projection 366 of the head unit 36 is facing from the back side (−Y side) toward the opening 535*c* of the guide groove 535. Next, as shown in FIG. 6B, the engaging projection 366 of the head unit 36 is inserted from the opening 535*c* of the guide groove 535, and pushed to the front side (+Y side) of the Y direction along the guide groove 535. At this time, the direction in which the two engaging projections 366 are aligned is regulated so as to go along the tilted part 535*a* of the guide groove 535. Because of that, the head unit 36 is inserted in the unit mounting part 53 while being held in an orientation tilted in relation to the Y direction following the tilt of the tilted part 535*a* of the guide groove 535. As shown in FIG. 6C, from after the engaging projection 366 is held over the boundary of the guide groove 535 tilted part 535*a* and parallel part 535*b*, the direction in which the two engaging projections 366 are aligned is regulated so as to be along the parallel part 535*b* of the guide groove 535. Because of that, with FIG. 6C to FIG. 6D, the head unit 36 is inserted in the unit mounting part 53 while being held in an orientation roughly parallel to the Y direction. As a result, as shown in FIG. 6D, while the front end (+Y side end) of the head plate 362 is engaged with the engaging part 531*a* of the front plate 531, the back end (−Y side end) of the head plate 362 is engaged with the engaging part 533*a* of the rear plate, and the head unit 36 is aligned in relation to the unit mounting part 53.

In this way, the head unit 36 is mounted in the unit mounting part 53 with a trajectory P36 shown by a dotted line in FIG. 6A moving toward the front side (+Y side) of the Y direction. The description above is an example of the operation of mounting the head unit 36 in the unit mounting part 53. On the other hand, for the operation of removing the head unit 36 from the unit mounting part 53, it is possible to execute that using the reverse procedure to the procedure described above. Therefore, the head unit 36 is removed from the unit mounting part 53 with the trajectory P36 moving toward the back side (−Y side) of the Y direction.

Figure 7:
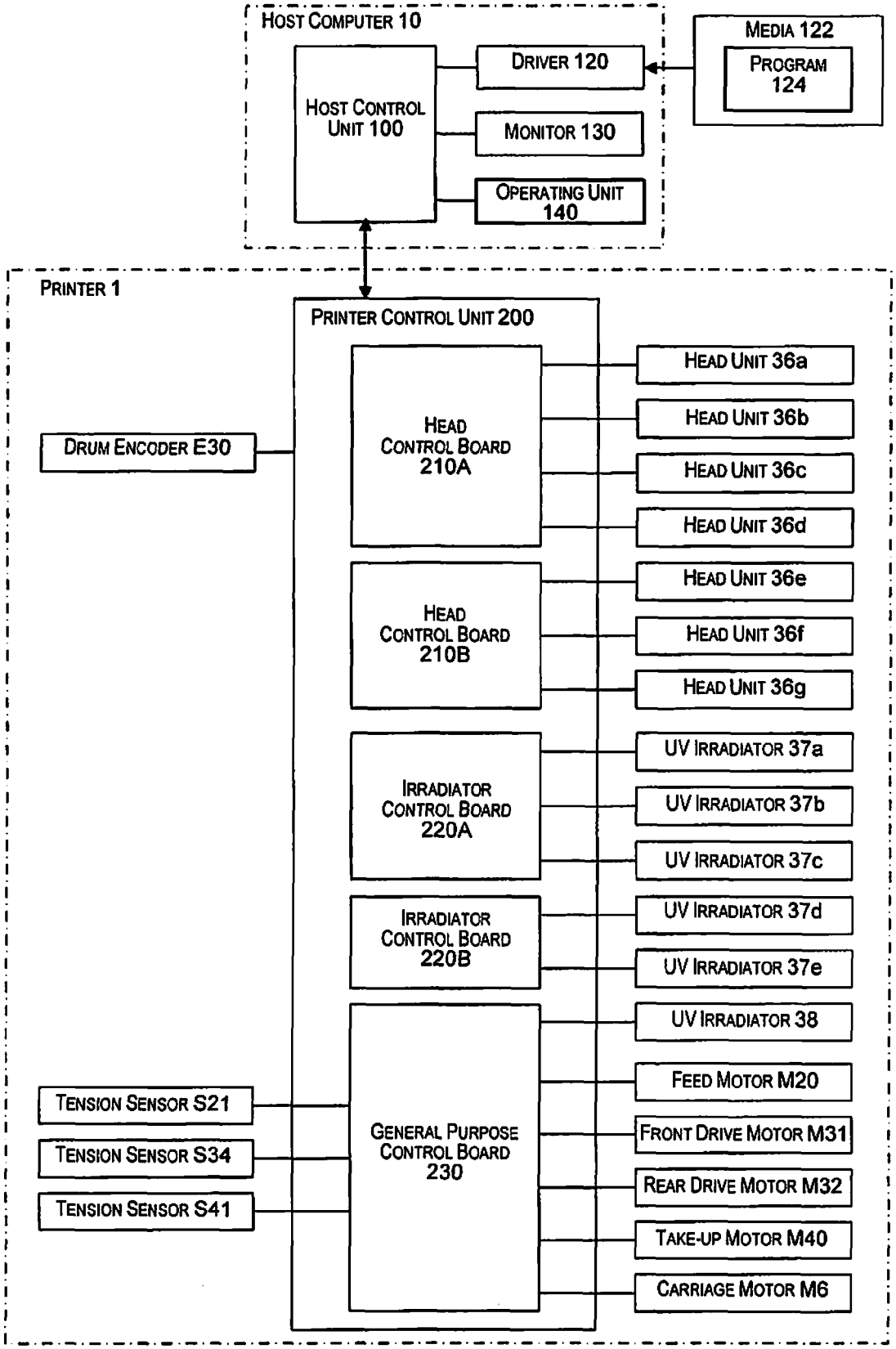
FIG. 7 is a block diagram showing the typical electrical configuration for controlling the printer shown in FIG. 1 through FIGS. 6A-6D.

The above description is a summary of the device constitution of the printer 1. Following, we will describe the electrical configuration for controlling the printer 1. FIG. 7 is a block diagram typically showing the electrical configuration for controlling the printer 1 shown in FIGS. 1 through 6D. The operation of the printer 1 described above is controlled by a host computer 10 shown in FIG. 7. The host computer 10 can be equipped with the printer 1, or can be equipped separately external to the printer 1. With the host computer 10, a host control unit 100 that is in charge of the control operation is constituted by a CPU (Central Processing Unit) or memory. Also, a driver 120 is provided in the host computer 10, and this driver 120 reads a program 124 from a media 122. As the media 122, it is possible to use various items including a CD (Compact Disk), a DVD (Digital Versatile Disk), USB (Universal Serial Bus) memory or the like. Also, the host control unit 100 performs control of each part of the host computer 10 or control of the operation of the printer 1 based on the program 124 read from the media 122.

Also, as an interface for the operator to the host computer 10, provided are a monitor 130 constituted by a liquid crystal display or the like, and an operating unit 140 constituted by a keyboard, mouse, or the like. In addition to an image of the printing subject, a menu screen is also displayed on the monitor 130. Therefore, by the operator operating the operating unit 140 while checking the monitor 130, a print setting screen is opened from the menu screen, and it is possible to set various printing conditions such as print media type, print media size, print quality and the like. It is possible to have various modifications to the specific constitution of the interface with the operator, for example it is also possible to use a touch panel display as the monitor 130, and to constitute the operating unit 140 with the touch panel of this monitor 130.

Meanwhile, a printer control unit 200 that controls each part of the printer 1 according to instructions from the host computer 10 is provided with the printer 1. Also, each device part including the head unit, the UV irradiator, and the sheet conveyance system is controlled by the printer control unit 200. The details of control by the printer control unit 200 on each of these device parts are as noted hereafter.

The printer control unit 200 has head control boards 210A and 210B that control the ink discharge timing of the head units 36*a* to 36*g* installed in the carriage 51 according to the conveyance of the sheet S. In more detail, this ink discharge timing control is executed based on the output (detection value) of a drum encoder E30 that is attached to the rotating shaft of the rotating drum 30 and detects the rotation position of the rotating drum 30. In other words, the rotating drum 30 does driven rotation following the conveyance of the sheet S, so if the output of the drum encoder E30 that detects the rotation position of the rotating drum 30 is referenced, it is possible to grasp the conveyance position of the sheet S. In light of that, the head control boards 210A and 210B generate pts (print timing signal) signals from the output of the drum encoder E30, and by controlling the ink discharge timing of the head units 36*a* to 36*g* based on the pts signal, the ink discharged by the head units 36*a* to 36*g* is made to impact target positions on the conveyed sheet S, and a color image is formed. Incidentally, the head control board 210A is in charge of control of the four head units 36*a* to 36*d*, and the head control board 210B is in charge of control of the three head units 36*e* to 36*g*.

Also, the printer control unit 200 has irradiator control boards 220A and 220B for controlling the light on and off timing and the irradiated light volume of the UV irradiators 37*a* to 37*e* installed in the carriage 51. At this time, the irradiator control board 220A is in charge of controlling the three UV irradiators 37*a* to 37*c*, and the irradiator control board 220B is in charge of controlling the two UV irradiators 37*d* and 37*e*.

Furthermore, the printer control unit 200 has a general purpose control board 230 for controlling function units not installed in the carriage 51 such as the UV irradiator 38, various motors and the like. In other words, the light on and off timing and irradiated light volume of the UV irradiator 38 is controlled by the general purpose control board 230. Also, conveyance of the sheet S described in detail using FIG. 1 is controlled by the general purpose control board 230. In other words, of the members constituting the sheet conveyance system, a motor is connected respectively to the feed shaft 20, the front drive roller 31, the rear drive roller 32, and the take-up shaft 40. Also, the general purpose control board 230 controls the speed and torque of each motor while rotating these motors, and controls the conveyance of sheet S. The details of this sheet S conveyance control are as noted hereafter.

The general purpose control board 230 rotates a feed motor M20 that drives the feed shaft 20 and supplies the sheet S from the feed shaft 20 to the front drive roller 31. At this time, the general purpose control board 230 controls the torque of the feed motor M20, and adjusts the sheet S tension (feed tension) from the feed shaft 20 to the front drive roller 31. In other words, a tension sensor S21 that detects feed tension is attached to the driven roller 21 arranged between the feed shaft 20 and the front drive roller 31. This tension sensor S21 can be constituted by load cells that detect force received from the sheet S, for example. Also, the general purpose control board 230 does feedback control of the torque of the feed motor M20 based on the detection results of the tension sensor S21 and adjusts the feed tension of the sheet S.

Also, the general purpose control board 230 rotates the front drive motor M31 that drives the front drive roller 31 and the rear drive motor M32 that drives the rear drive roller 32. By doing this, the sheet S fed from the feed unit 2 passes through the processing unit 3. At this time, while speed control is executed on the front drive motor M31, torque control is executed on the rear drive motor M32. In other words, the general purpose control board 230 adjusts the rotation speed of the front drive motor M31 to be constant based on the encoder output of the front drive motor M31. By doing this, the sheet S is conveyed at a constant speed by the front drive roller 31.

Meanwhile, the general purpose control board 230 adjusts the tension of the sheet S (process tension) from the front drive roller 31 to the rear drive roller 32 by controlling the torque of the rear drive motor M32. In other words, a tension sensor S34 that detects process tension is attached to the driven roller 34 arranged between the rotating drum 30 and the rear drive roller 32. This tension sensor S34 can for example be constituted using load cells that detect the force received from the sheet S. Also, the general purpose control board 230 adjusts the process tension of the sheet S by doing feedback control of the torque of the rear drive motor M32 based on the detection results of the tension sensor S34.

Also, the general purpose control board 230 rotates the take-up motor M40 that drives the take-up shaft 40 and winds the sheet S conveyed by the rear drive roller 32 onto the take-up shaft 40. At this time, the general purpose control board 230 controls the torque of the take-up motor M40 and adjusts the tension of the sheet S (take-up tension) from the rear drive roller 32 to the take-up shaft 40. In other words, a tension sensor S41 that detects take-up tension is attached to the driven roller 41 arranged between the rear drive roller 32 and the take-up shaft 40. This tension sensor S41 can be constituted, for example, by load cells that detect the force received from the sheet S. Also, the general purpose control board 230 does feedback control of the torque of the take-up motor M40 based on the detection results of the tension sensor S41 and adjusts the take-up tension of the sheet S.

The general purpose control board 230 is also in charge of controlling a carriage motor M6 that drives the carriage 51 in the Y direction. In specific terms, the general purpose control board 230 selectively aligns the carriage 51 at the printing position Ta, the automatic maintenance position Tb, and the manual operation maintenance position Tc by controlling the carriage motor M6 according to instructions from the operator input via the operating unit 140.

In this way, with the printer 1, there is separation of the control boards 210A, 210B, 220A, and 220B for the functional units 36*a* to 36*g* and 37*a* to 37*e* installed in the carriage 51 and the control board 230 for the UV irradiator 38, and M20, M31, M32, M40, and M6 not installed in the carriage 51. Also, the control boards 210A, 210B, 220A, and 220B are constituted installed in the carriage 51 and moving along with the carriage 51, and the control board 230 is arranged separately from the carriage 51.

Figure 8:
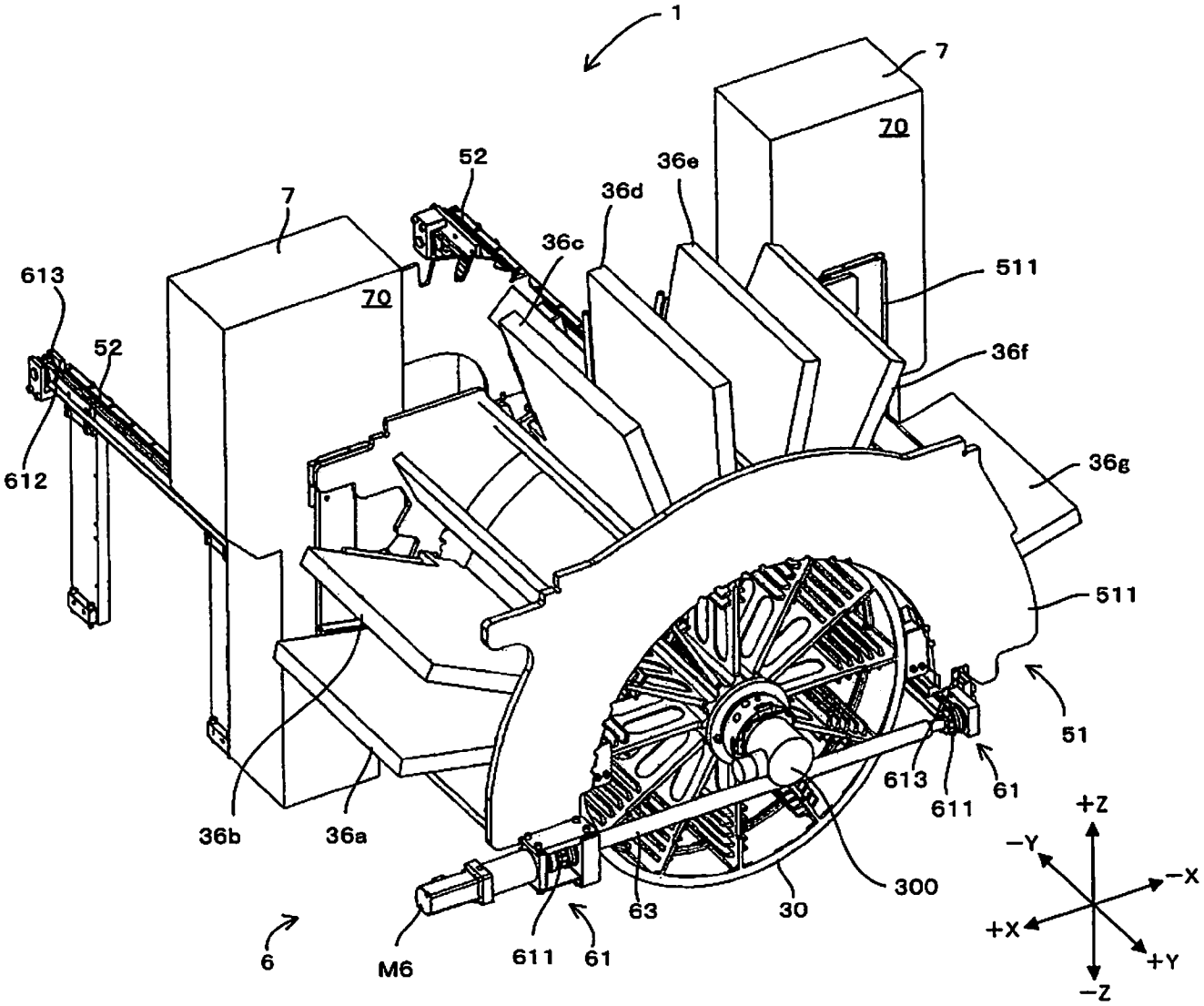
FIG. 8 is a perspective view showing an example of the internal constitution of the printer shown in FIG. 1 through FIG. 7.

The above description is a summary of the device constitution of the printer 1. Following, we will give a more detailed description of the device constitution of the printer 1. FIG. 8 is a perspective view showing an example of the internal constitution of the printer 1 shown in FIG. 1 through FIG. 7. In the drawing, an example is shown in a state with the carriage 51 positioned at the printing position Ta. As shown in FIG. 8, the head units 36*a* to 36*g* and the UV irradiators 37*a* to 37*e* are held sandwiched from the Y direction by the arc parts of the two support frames 511. Also, the ink supply system 7 is held attached to the back side (−Y side) support frame 511. As described above, the carriage 51 is stretched across two guide rails 52 provided at both end parts in the X direction (conveyance direction Ds), and is guided by these guide rails 52 and able to move in the Y direction. Also, the carriage 51 is driven in the Y direction along the guide rails 52 by the drive mechanism 6 shown in FIG. 8.

In specific terms, the drive mechanism 6 has a conveyer 61 constituted by a drive pulley 611, a driven pulley 612, and a belt 613 stretched across the pulleys 611 and 612. The pulleys 611 and 612 are toothed pulleys having a row of teeth for which a plurality of teeth are aligned at a designated pitch, and the belt 613 is a toothed belt having a row of teeth for which a plurality of teeth are aligned at a designated pitch. Also, in a state with the teeth of the respective pulleys 611 and 612 and the teeth of the belt 613 mutually engaged, the belt 613 is wound onto the pulleys 611 and 612. Therefore, when the drive pulley 611 is rotated, the belt 613 rotates following the drive pulley 611, and the driven pulley 612 rotates following the rotation of the belt 613. At this time, the drive pulley 611 and the driven pulley 612 are arranged aligned in the front-back direction Y, so of the belt 613, the part stretched between the pulleys 611 and 612 moves along the front-back direction Y. Also, both end parts of the belt 613 are fixed to the base frame 512 (FIG. 3) of the carriage 51. Therefore, when the belt 613 rotates following the drive pulley 611, the carriage 51 moves in the Y direction along with the belt 613. With the drive mechanism 6, the constitution is such that this kind of conveyor 61 is adjacent respectively to the left side (+X side) of the X direction of each guide rail 52, and the belt 613 of each conveyor 61 can be moved in the front-back direction Y along the adjacent guide rails 52.

The drive mechanism 6 has a link shaft 63 extending in the Y direction, and the drive pulley 611 of the conveyor 61 provided at the left end part and the drive pulley 611 of the conveyor 61 provided at the right end side are connected to each other by the link shaft 63. Therefore, power is transmitted via the link shaft 63 between the left end part drive pulley 611 and the right end part drive pulley 611, and these two drive pulleys 611 rotate synchronously. Furthermore, the drive mechanism 6 has the motor M6 that drives the left end part drive pulley 611 and rotates that drive pulley. Therefore, by rotating the motor M6, it is possible to synchronously rotate the belts 613 respectively wound on the two drive pulleys 611. To describe this in more detail, the diameters of the two drive pulleys 611 are equal to each other, and the tooth array pitch for the rows of teeth of the two belts 613 are also equal to each other. Therefore, when the motor M6 is rotated, the rows of teeth provided on the two drive pulleys 611 move at the same speed as each other, and the two belts 613 also move at the same speed to each other and toward the same direction (front-back direction Y). In this way, when the two belts 613 provided on the left and right end parts are synchronously rotated, the carriage 51 receives the drive force transmitted from each belt 613, and moves it in the Y direction along the guide rails 52 of the left and right end parts. Incidentally, the motor M6 rotates according to instructions input via the operating unit 140 (FIG. 7) by the operator, and aligns the carriage 51.

Figure 9B:
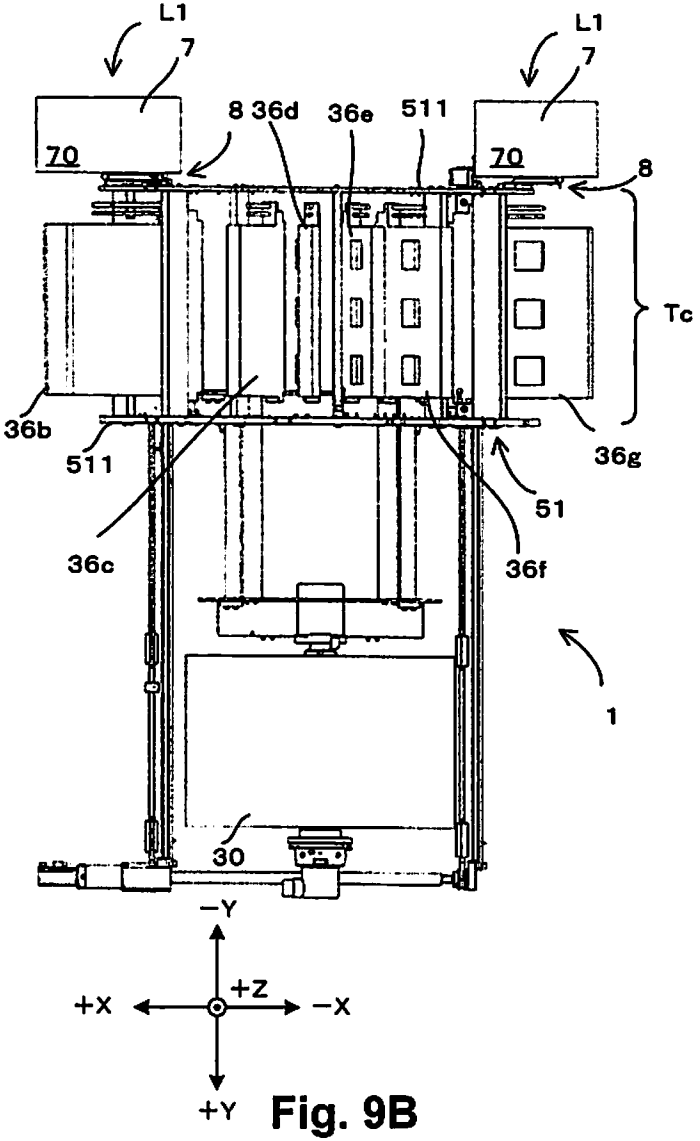
FIG. 9B is a drawing showing the example of the stage when the carriage is positioned at the manual operation maintenance position.
Figure 9A:
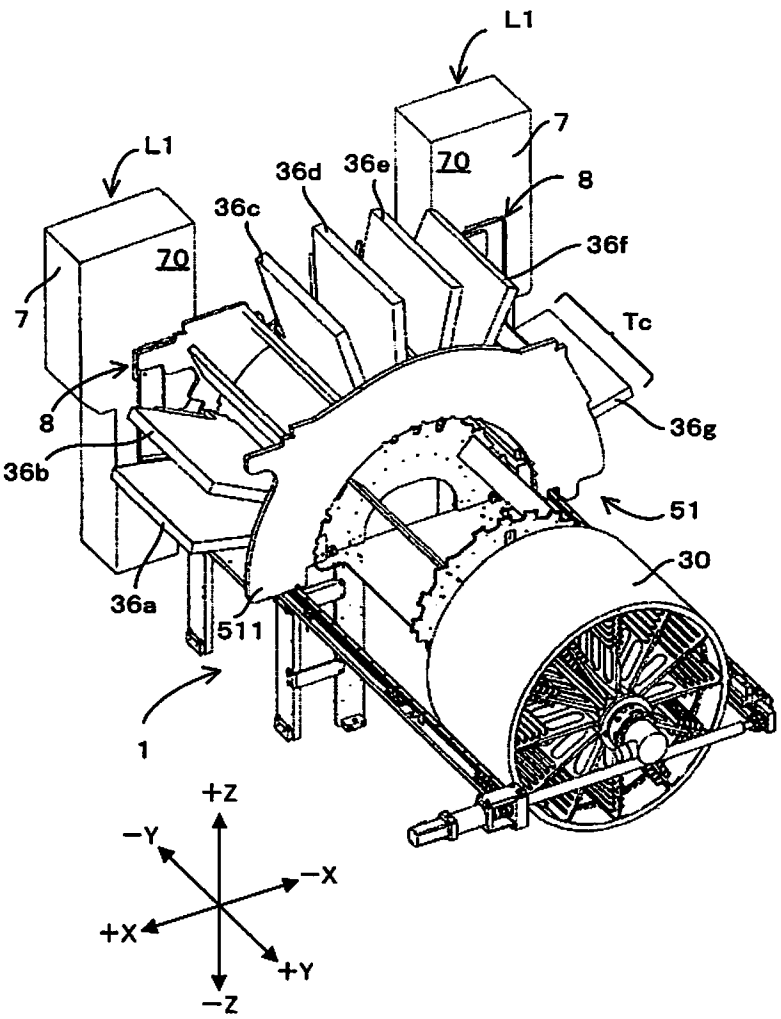
FIG. 9A is a drawing showing an example of the stage when the carriage is positioned at the manual operation maintenance position.

Also, attaching and detaching of the head units 36*a* to 36*g* on the seven unit mounting parts 53 fixed to the carriage 51 is executed by manual operation by moving the carriage 51 to the manual operation maintenance position Tc as shown in FIGS. 9A and 9B. Here, FIGS. 9A and 9B are drawings showing an example of the internal constitution of the printer 1 in a state with the carriage 51 positioned in the manual operation maintenance position, with FIG. 9A showing an example with a perspective view, and FIG. 9B showing an example with a plan view.

Incidentally, as described above, attaching and detaching of the head units 36*a* to 36*g* to the unit mounting parts 53 is executed from the back side (−Y side) of the Y direction. In contrast to this, as can be understood from FIG. 1, FIGS. 9A and 9B, and the like, there are no members that become obstacles at the back side (−Y side) in the Y direction of the four head units 36*c*, 36*d*, 36*e*, and 36*f* mounted at the center part among the head units 36*a* to 36*g*, so space that can be used for attachment and detachment work is ensured. Therefore, it is possible to execute attaching and detaching of the head units 36*c*, 36*d*, 36*e*, and 36*f* on the unit mounting parts using that space. Meanwhile, since the ink supply system 7 is positioned at the back side (−Y side) of the Y direction of the head units 36*a*, 36*b*, and 36*g* mounted on both end parts among the head units 36*a* to 36*g*, there is no space that can be used for attaching and detaching work. To deal with this, with this embodiment, the carriage 51 holds the ink supply system 7 via a rotational coupling component 8, and the ink supply system 7 can be moved between a first position L1 at which the ink supply system 7 is arranged in FIGS. 9A and 9B, and a second position L2 (in FIGS. 11A and 11B described later) further to the inside in the X direction than the first position L1.

Figure 10A:
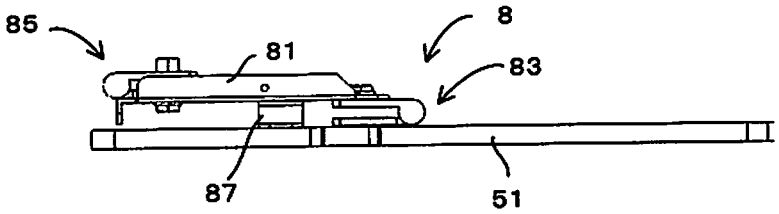
FIG. 10A is a drawing showing an example of a rotational coupling component that couples the carriage and the ink supply system.
Figure 10B:
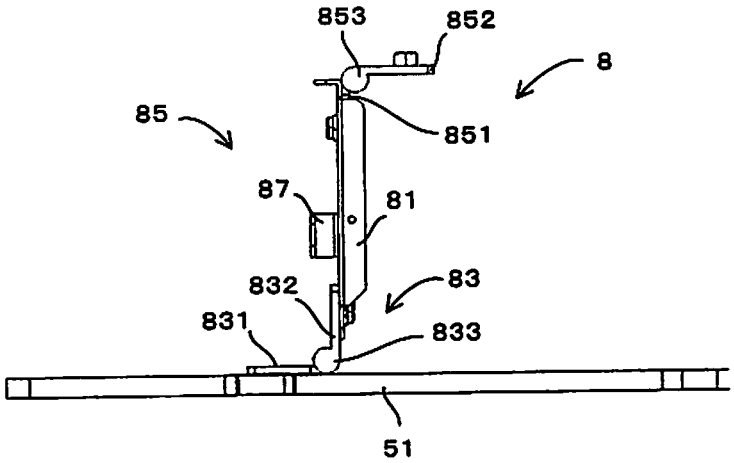
FIG. 10B is a drawing showing the example of the rotational coupling component that couples the carriage and the ink supply system.
Figure 10C:
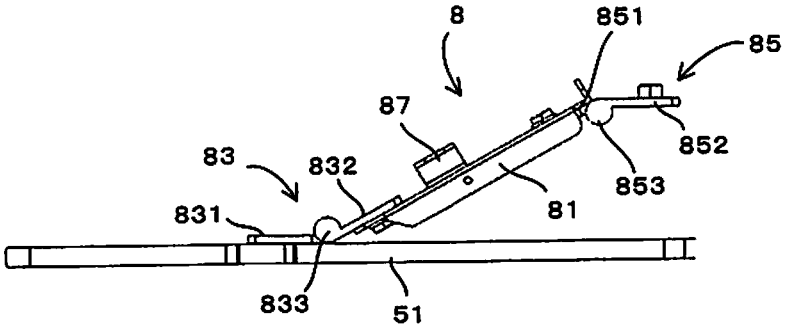
FIG. 10C is a drawing showing the example of the rotational coupling component that couples the carriage and the ink supply system.

FIGS. 10A-10C are drawings showing an example of the rotational coupling component 8 that couples the carriage 51 and the ink supply system 7. Each of FIGS. 10A through 10C shows an example of a different operating state of the rotational coupling component 8, and in specific terms, FIG. 10A corresponds to when the ink supply system 7 is positioned at the first position L1, FIG. 10C corresponds to when the ink supply system is positioned at the second position L2 (the state shown in FIGS. 11A and 11B described later), and FIG. 10B corresponds to when the ink supply system 7 is positioned between positions L1 and L2.

As shown in the drawing, the rotational coupling component 8 has a schematic constitution with which hinges 83 and 85 are attached to both ends of a metal arm 81. The hinge 83 has two metal plates 831 and 832, and a rotating shaft 833 that connects these metal plates 831 and 832 to be able to rotate with each other, and the hinge 85 has two metal plates 851 and 852, and a rotating shaft 853 that connects the metal plates 851 and 852 to be able to rotate with each other. The metal plate 832 of the hinge 83 is attached to one end of the arm 81, and the metal plate 851 of the hinge 85 is attached to the other end of the arm 81, and each rotating shaft 833 and 853 of the hinges 83 and 85 faces the vertical direction Z.

Also, the metal plate 831 of the hinge 83 attached to one end of the arm 81 is attached to the support frame 511 of the back side (−Y side) of the carriage 51, and the metal plate 853 of the hinge 85 attached to the other end of the arm 81 is attached to the side wall of the housing 70 of the ink supply system 7. Therefore, the ink supply system 7 is able to rotate with a relatively large diameter with the rotating shaft 833 as the center, and also to rotate with a relatively small diameter with the rotating shaft 853 as the center. At this time, the rotating shafts 833 and 853 of the hinges 83 and 85 are facing the vertical direction Z, so the ink supply system 7 moves horizontally. As a result, it is possible to inhibit the effect of the movement of the ink supply system 7 on the head differential of the tank 710 and the nozzles N.

Incidentally, an engaging member 87 is provided at the side surface of the arm 81, and in the state shown in FIG. 10A, the engaging member 87 engages with the carriage 51, and it is possible to regulate the rotation of the arm 81 with the rotating shaft 833 as the center. In other words, by the engaging member 87 engaging with the carriage 51, it is possible to make the ink supply system 7 in the first position L1 be relatively immobile in relation to the carriage 51. The engaging of the engaging member 87 to the carriage 51 is constituted so as to be easily released by the manual operation of the operator.

Figure 11B:
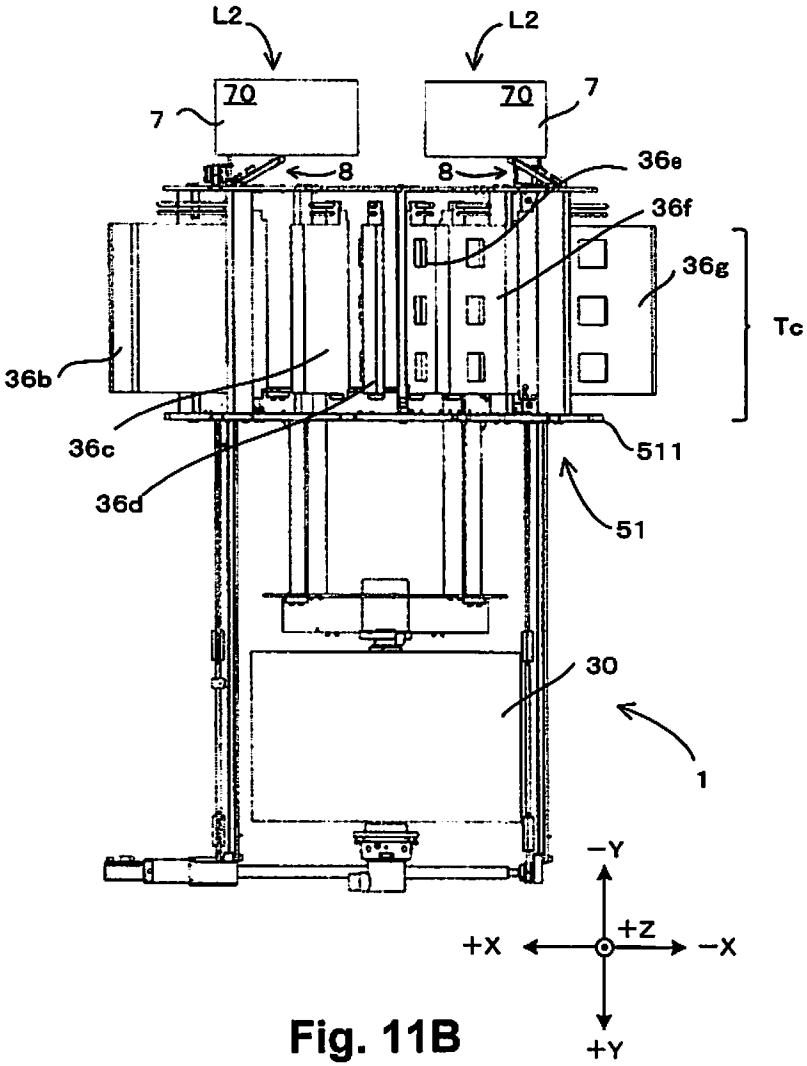
FIG. 11B is a drawing showing the example of the state when the carriage is positioned in the manual operation maintenance position.
Figure 11A:
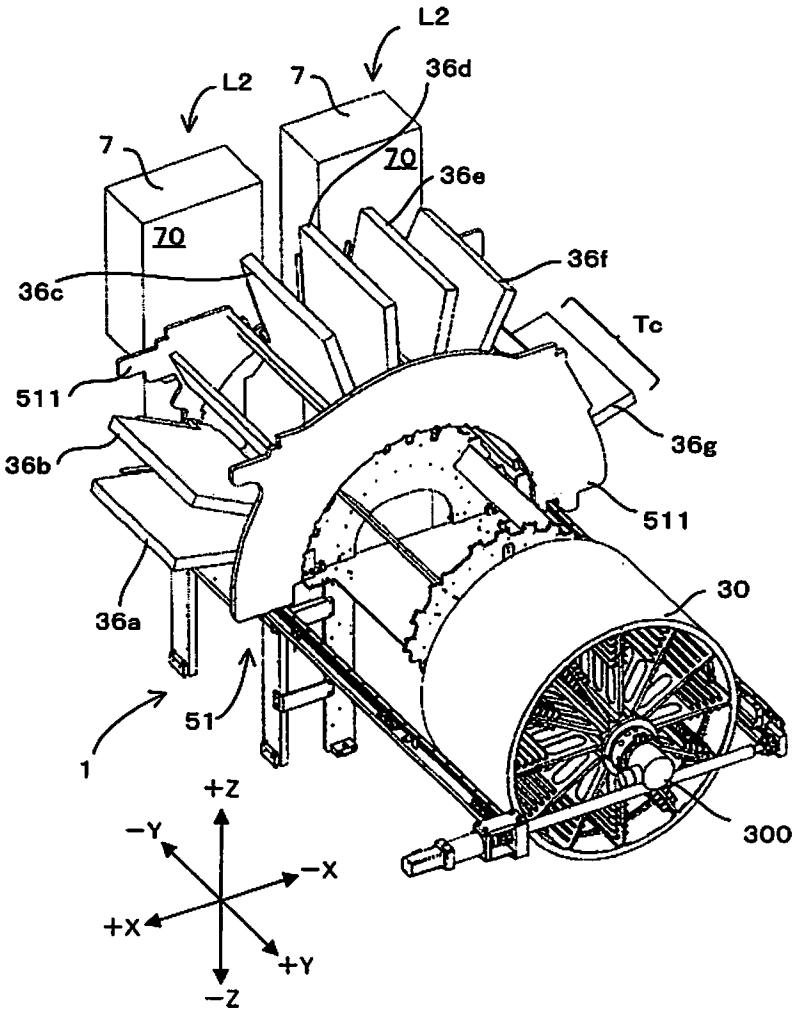
FIG. 11A is a drawing showing an example of the state when the carriage is positioned in the manual operation maintenance position.

When attaching and detaching the head units 36*a*, 36*b*, and 36*g* to the carriage 51, as shown in FIGS. 11A and 11B, each ink supply system 7 is rotated in the X direction to the second position L2 further to the inside than the first position L1.

Here, FIGS. 11A and 11B are drawings showing an example of the internal constitution of the printer 1 in a state with the carriage 51 positioned in the manual operation maintenance position, where FIG. 11A shows an example with a perspective view, and FIG. 11B shows an example with a plan view. By doing this, each ink supply system 7 which has become an obstacle is removed from the back side (−Y side) in the Y direction of the head units 36*a*, 36*b*, and 36*g*, and space which can be used for attachment and detachment work is ensured. As a result, by using that space, it is possible to execute attachment and detachment of the head units 36*a*, 36*b*, and 36*g* on the unit mounting parts 53.

In this way, while the first position L1 faces opposite from the back side (−Y side) of the Y direction to the mounting locations of the head units 36*a*, 36*b*, and 36*g* (said another way, unit mounting parts 53), it is separated from the back side (−Y side) of the Y direction of the head unit 36*c*, 36*d*, 36*e*, and 36*f* mounting locations (said another way, the unit mounting parts 53). Therefore, while the ink supply system 7 positioned at the first position L1 overlaps the trajectory P36 through which the head units 36*a*, 36*b*, and 36*g* being attached and detached with the carriage 51 pass, it is separated to the outside in the X direction from the trajectory P36 through which the head units 36*c*, 36*d*, 36*e*, and 36*f* being attached and detached with the carriage 51 pass. Thus, by the ink supply system 7 being positioned at the first position L1, it is possible to attach and detach the head units 36*c*, 36*d*, 36*e*, and 36*f* with the carriage 51.

Meanwhile, while the second position L2 faces opposite from the back side (−Y side) of the Y direction to the mounting locations of the head units 36*c*, 36*d*, 36*e*, and 36*f* (said another way, unit mounting parts 53), it is separated from the back side (−Y side) of the Y direction of the head unit 36*a*, 36*b*, and 36*g* mounting locations (said another way, the unit mounting parts 53). Therefore, while the ink supply system 7 positioned at the second position L2 overlaps the trajectory P36 through which the head units 36*c*, 36*d*, 36*e*, and 36*f* being attached and detached with the carriage 51 pass, it is separated to the outside in the X direction from the trajectory P36 through which the head units 36*a*, 36*b*, and 36*g* being attached and detached with the carriage 51 pass. Thus, by the ink supply system 7 being positioned at the second position L2, it is possible to attach and detach the head units 36*a*, 36*b*, and 36*g* with the carriage 51.

The first position L1 and the second position L2 are defined as relative positions in relation to the carriage 51, and move in accordance with the carriage 51. Also, when the carriage 51 is positioned at the manual operation maintenance position Tc, the movement path of the ink supply system 7 between the first position L1 and the second position L2 is separated from the maintenance unit MU and the rotating drum 30, and the constitution is such that it is possible for the ink supply system 7 to move between the first position L1 and the second position L2 without interfering with the maintenance unit MU and the rotating drum 30.

As described above, with this embodiment, the ink supply system 7 is constituted to be able to move in relation to the carriage 51 between the first position L1 and the second position L2, and at the first position L1, while the ink supply system 7 overlaps the trajectory P36 through which the head units 36*a*, 36*b*, and 36*g* pass when being attached or detached with the carriage 51, at the second position L2, it is separated from the trajectory P36 through which the head units 36*a*, 36*b*, and 36*g* pass when being attached or detached with the carriage 51. Therefore, when the head units 36*a*, 36*b*, and 36*g* are not being attached or detached with the carriage 51, it is acceptable to position the ink supply system 7 at the first position L1. On the other hand, when attaching and detaching the head units 36*a*, 36*b*, and 36*g* with the carriage 51, if the ink supply system 7 is positioned at the second position L2, it is possible to perform attachment and detaching of the head units 36*a*, 36*b*, and 36*g* with the carriage 51 while avoiding interference of the head units 36*a*, 36*b*, and 36*g* and the ink supply system 7.

However, with the kind of constitution described above, while the head units 36*a*, 36*b*, and 36*g* are discharging ink on the sheet S, or when the head units 36*a*, 36*b*, and 36*g* are undergoing maintenance by the maintenance unit MU, the head units 36*a*, 36*b*, and 36*g* cannot be attached and detached with the carriage 51 in the first place. Therefore, there is no need to consider interference of the head units 36*a*, 36*b*, and 36*g* and the ink supply system 7 in accordance with attaching and detaching of the head units 36*a*, 36*b*, and 36*g* with the carriage 51. Meanwhile, when the carriage 51 is positioned at the position Tc at which the head units 36*a*, 36*b*, and 36*g* are separated from the rotating drum 30 and the maintenance unit MU, the head units 36*a*, 36*b*, and 36*g* are not provided for ink discharge or maintenance, so it is possible to attach and detach with the carriage 51.

With this embodiment, when the carriage 51 is positioned at the position Tc at which the head units 36*a*, 36*b*, and 36*g* held in the carriage 51 are separated from the rotating drum 30 and the maintenance unit MU, the rotating drum 30 and the maintenance unit MU are separated from the second position L2. Therefore, it is possible to position the ink supply system 7 at the second position L2 while avoiding interference with the rotating drum 30 and the maintenance unit MU, and to provide attaching and detaching of the head units 36*a*, 36*b*, and 36*g* with the carriage 51.

Also, with this embodiment, it is possible to move the ink supply system 7 in relation to the carriage 51 with the degree of freedom of having two hinges 83 and 85. Therefore, it is possible to move the ink supply system 7 between the first position L1 and the second position L2 by revolving the ink supply system 7 around the carriage 51 while inhibiting rotation of the ink supply system 7.

This is particularly suitable for the constitution noted above equipped with flexible piping 711*a* and 713*a* connecting from the ink supply system 7 to the head units 36*a*, 36*b*, and 36*g*. This is because it is possible to inhibit the piping 711*a* and 713*a* bending to the extreme, and winding of the piping 711*a* and 713*a* on the ink supply system 7 due to the rotation of the ink supply system 7.

Also, with this embodiment, there are the head units 36*c*, 36*d*, 36*e*, and 36*f* that discharge ink held to be able to be attached and detached with the carriage 51. Also, the constitution is such that when the ink supply system 7 is in the first position L1, it is separated from the trajectory P36 through which the head units 36*c*, 36*d*, 36*e*, and 36*f* being attached and detached with the carriage 51 pass, and when in the second position L2, is overlapping the trajectory P36 through which the head units 36*c*, 36*d*, 36*e*, and 36*f* being attached and detached with the carriage 51 pass.

In other words, with this embodiment, as described above, by positioning the ink supply system 7 at the second position L2, it is possible to perform attaching and detaching of the head units 36*a*, 36*b*, and 36*g* with the carriage 51 while avoiding interference of the head units 36*a*, 36*b*, and 36*g* with the ink supply system 7. Incidentally, for the head units 36*c*, 36*d*, 36*e*, and 36*f* attached and detached with the carriage 51 as well, when avoiding interference of the ink supply system 7 positioned at the second position L2, it is necessary to separate from the second position L2 not only for the trajectory P36 in which the head units 36*a*, 36*b*, and 36*g* are attached and detached, but also the trajectory P36 for which the head units 36*c*, 36*d*, 36*e*, and 36*f* are attached and detached. Because of that, it is thought that it is necessary to ensure space for the second position L2 to be separated from all seven head units 36*a* to 36*g*, which invites a larger scale device.

In contrast to this, with this constitution, the trajectory P36 in which the head units 36*c*, 36*d*, 36*e*, and 36*f* are attached and detached with the carriage 51 overlaps the ink supply system 7 in the second position L2, but is separated from the ink supply system 7 in the first position L1. Therefore, by positioning the ink supply system 7 at the first position L1, it is possible to perform attaching and detaching of the head units 36*c*, 36*d*, 36*e*, and 36*f* with the carriage 51 while avoiding interference of the head units 36*c*, 36*d*, 36*e*, and 36*f* and the ink supply system 7. Thus, it is not necessary to ensure space for the second position L2 up to being separated from the head units 36*c*, 36*d*, 36*e*, and 36*f*. As a result, it is possible to attach and detach the seven head units 36*a* to 36*g* with the carriage 51 while avoiding interference of the seven head units 36*a* to 36*g* and the ink supply system 7, and further possible to make the device more compact.

Also, with this embodiment, the constitution is such that the ink supply system 7 can be moved in relation to the carriage 51 between the first position L1 and the second position L2. Also, when the ink supply system 7 is positioned at the first position L1, it is not possible to attach and detach the head units 36*a*, 36*b*, and 36*g* with the carriage 51, and when the ink supply system 7 is positioned at the second position L2, it is possible to attach and detach the head units 36*a*, 36*b*, and 36*g* with the carriage 51. Therefore, when not attaching and detaching the head units 36*a*, 36*b*, and 36*g* with the carriage 51, it is possible to position the ink supply system 7 at the first position L1. Meanwhile, when attaching and detaching the head units 36*a*, 36*b*, and 36*g* with the carriage 51, if the ink supply system 7 is positioned at the second position L2, it is possible to perform attaching and detaching of the head units 36*a*, 36*b*, and 36*g* with the carriage 51 while avoiding interference of the head units 36*a*, 36*b*, and 36*g* and the ink supply system 7.

In this way, with this embodiment, the printer 1 correlates to an example of the "image recording device" of the invention, the head units 36*a*, 36*b*, and 36*g* correlate to an example of the "first head unit" of the invention, the head units 36*c*, 36*d*, 36*e*, and 36*f* correlate to an example of the "second head unit" of the invention, the carriage 51 correlates to an example of the "unit holder" of the invention, the ink supply system 7 correlates to an example of the "member" or the "liquid supply system" of the invention, trajectory P36 correlates to an example of the "first trajectory" or the "second trajectory" of the invention, the rotational coupling component 8 correlates to an example of the "coupling member" of the invention, the first position L1 correlates to an example of the "first position" of the invention, the second position L2 correlates to an example of the "second position" of the invention, the printing position Ta correlates to an example of the "third position" of the invention, the automatic maintenance position Tb correlates to an example of the "fourth position" of the invention, the manual operation maintenance position Tc correlates to an example of the "fifth position" of the invention, the sheet S correlates to an example of the "recording medium" of the invention, the ink correlates to an example of the "liquid" of the invention, the rotating drum 30 correlates to an example of the "support unit" of the invention, the maintenance unit MU correlates to an example of the "maintenance unit" of the invention, the arm 81 correlates to an example of the "connecting part" of the invention, the hinge 83 correlates to an example of the "first hinge" of the invention, the hinge 85 correlates to an example of the "second hinge" of the invention, and the piping 711*a* and 713*a* correlate to an example of the "flexible member" of the invention.

Figure 12:
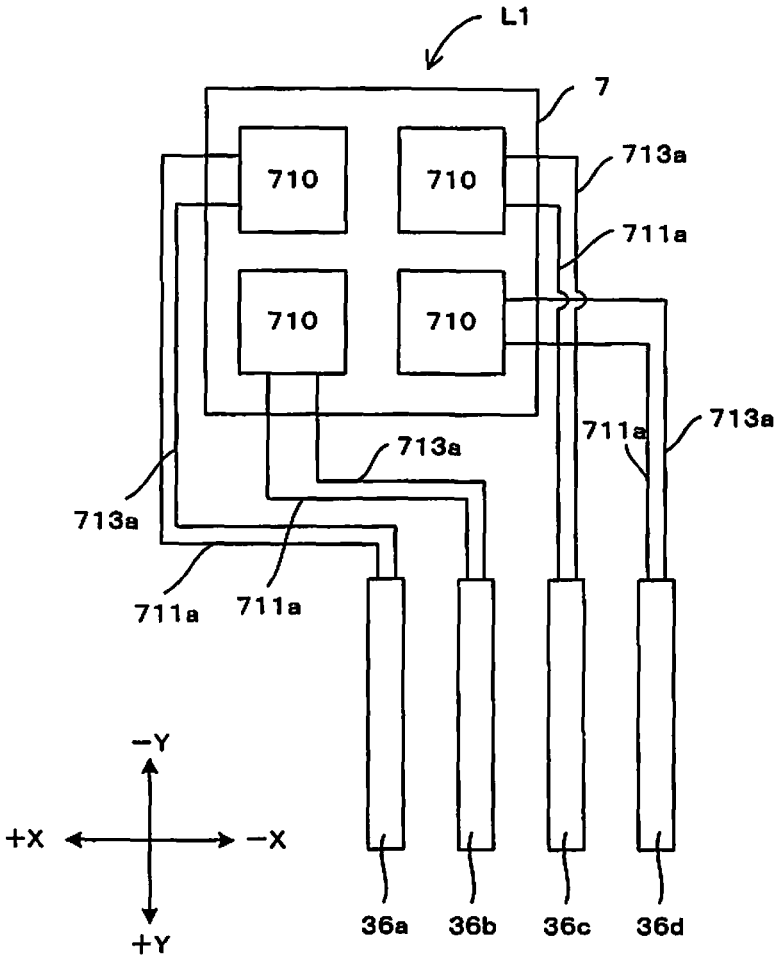
FIG. 12 is a plan view showing a typical example of the arrangement relationship of the tank and the head unit.

The invention is not limited by the embodiments noted above, and various modifications can be added to the items described above as long as they do not stray from the gist. For example, with the description noted above, there was no particularly detailed description regarding the arrangement relationship of the tank 710 and the head unit 36 housed in the ink supply system 7. In light of that, these can also be arranged as shown in FIG. 12. Here, FIG. 12 is a plan view showing a typical example of the arrangement relationship of the tank and head unit housed in the ink supply system 7, and shows an example of when the ink supply system 7 is in the first position L1. As shown in the drawing, inside the ink supply system 7, two tanks 710 are aligned in the Y direction at the X direction left side (+X side), and two tanks 710 are aligned in the Y direction at the X direction right side (−X side). Also, of the four head units 36*a* to 36*d*, the head units 36*a* and 36*b* arranged at the X direction left side (+X side) are connected by the piping 711*a* and 713*a* with the tank 710 arranged in the X direction left side (+X side) inside the ink supply system 7. Also, of the four head units 36*a* to 36*d*, the head units 36*c* and 36*d* arranged at the X direction right side (−X side) are connected by the piping 711*a* and 713*a* with the tank 710 arranged at the X direction right side (−X side) inside the ink supply system 7. Moreover, the length of each piping 711*a* and 713*a* is the same as that of the unit heads 36*a* to 36*d*. With this kind of constitution, even when the ink supply system 7 moves between the first position L1 and the second position L2, there is the advantage of being able to inhibit the piping 711*a* and 713*a* from becoming entangled or from being wound onto the ink supply system 7.

Figure 13:
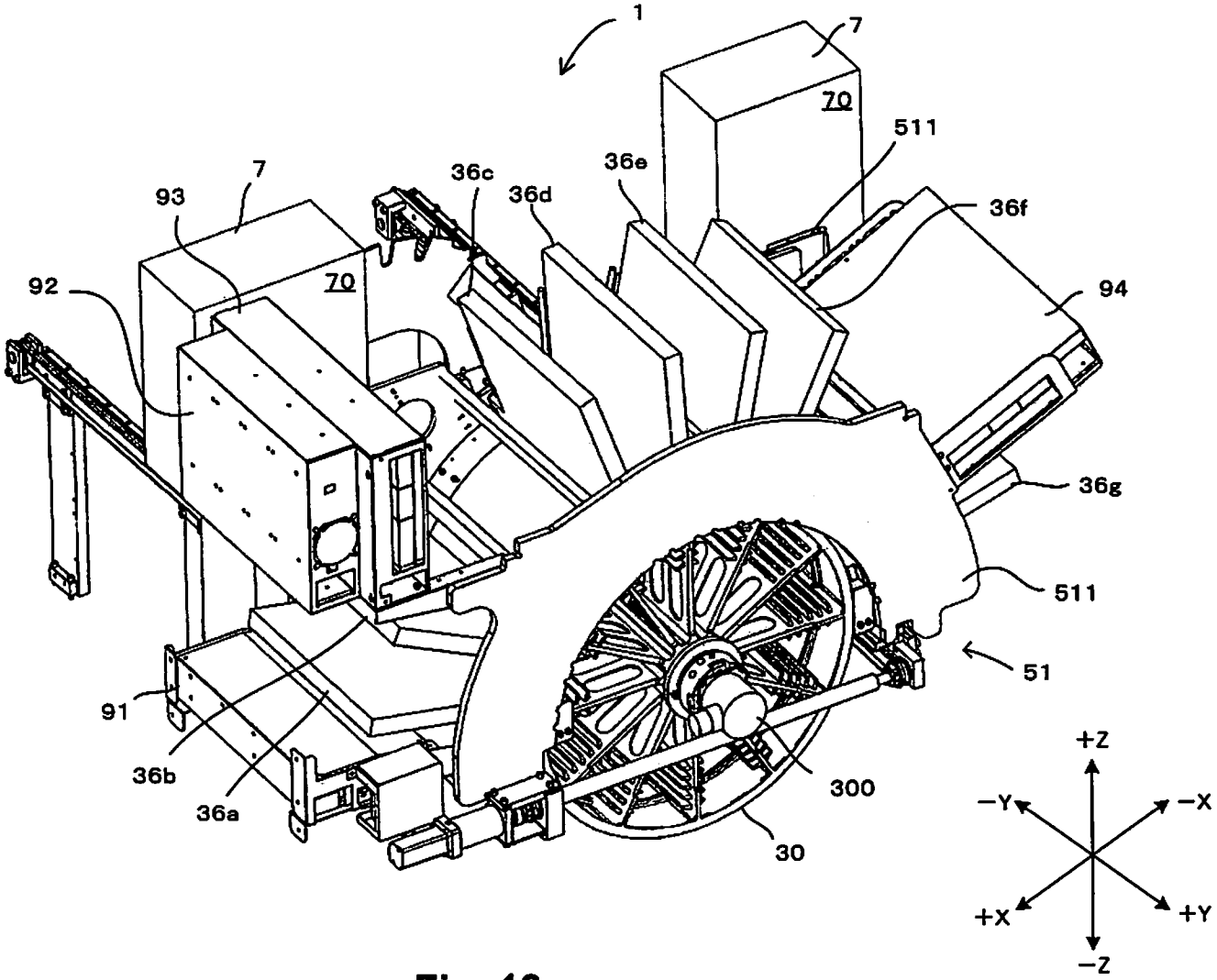

Also, with the description noted above, there was no particularly detailed description regarding specific arrangements of the electrical configuration that the printer 1 has. In light of that, it is also possible to arrange each electrical configuration as shown in FIG. 13. Here, FIG. 13 is a perspective view showing an example of the electrical configuration arrangement that the printer 1 has. As shown in the drawing, with the printer 1 of FIG. 13, four housing boxes 91 to 94 are provided for housing the respective control boards. The housing box 91 is attached to the bottom part of the printer 1 separate from the carriage 51. Meanwhile, the housing boxes 92 to 94 are attached to the carriage 51 and can be moved along with the carriage 51. In more specific terms, the housing boxes 92 and 93 are attached to the end part of the carriage 51 left side (+X side), and the housing box 94 is attached to the end part of the carriage 51 right side (−X side). When the housing boxes 91 to 94 are arranged in this way, for example, the head control board 210A and the irradiator control board 220A can be housed in the housing boxes 92 and 93, and the head control board 210B and the irradiator control board 220B can be housed in the housing box 94. By doing this, it is possible to keep the length of the wire that connects the control boards 210A, 210B, 220A, and 220B and the housing boxes 92 to 94 short. Also, the general purpose control board 230 can be housed in the housing box 91.

Also, with this embodiment, by rotating the ink supply system 7, the ink supply system 7 was moved between the first position L1 and the second position L2. However, the specific mode of moving the ink supply system 7 between the first position L1 and the second position L2 is not limited to being rotation, and can also be linear movement, for example.

Also, with the embodiment noted above, an example was shown when using the ink supply system 7 as the "member"

of the invention. However, the item that can function as the "member" of the invention is not limited to being the ink supply system 7.

Also, with the embodiment noted above, an example was shown when applying the invention to the printer 1 that supports the sheet S on a cylindrical support unit (rotating drum 30). However, the specific constitution for supporting the sheet S is not limited to this. Therefore, it is also acceptable to have a constitution whereby the sheet S is supported on a flat plane that the flat plate shaped support unit has.

Also, the number of, arrangement of, and color discharged by the head units 36*a* to 36*g* or the like can also be changed as appropriate. The number of, arrangement of, and ultraviolet ray strength of the UV irradiators 37*a* to 37*e* and 38 and the like can also be changed as appropriate. Furthermore, the conveyance mode of the sheet S can also be changed as appropriate, and it is also acceptable to constitute such that the sheet S is conveyed by a mode other than the roll to roll mode noted above.

Also, with the embodiment noted above, the invention was applied to the printer 1 equipped with the head units 36*a* to 36*g* that discharge the UV ink. However, it is also acceptable to apply the invention to a printer equipped with a head unit that discharges an ink other than UV ink, such as water based ink such as resin ink or the like, for example. Alternatively, it is also acceptable to apply the invention to a printer that performs printing using an item other than ink such as toner or the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image recording device, comprising:

a first head unit configured to discharge a liquid;

a unit holder detachably holding the first head unit;

a member configured to move relative to the unit holder; and a flexible member that is flexible and fluidly connects the member with the first head unit, when a trajectory through which the first head unit passes when the first head unit is attached or detached with the unit holder is used as a first trajectory, the member being configured to move between a first position at which the member is positioned relative to the unit holder so as to overlap the first trajectory, and a second position at which the member is positioned relative to the unit holder so as to be separated from the first trajectory.

2. The image recording device according to claim 1, further comprising a coupling member fixed to the member and the unit holder, the coupling member coupling the member and the unit holder such that the member moves relative to the unit holder.

3. The image recording device according to claim 2, further comprising a support unit configured to support a recording medium, and a maintenance unit configured to implement maintenance on the first head unit, wherein the unit holder is configured to move together with the member between a third position at which the first head unit discharges the liquid on the recording medium supported on the support unit, a fourth position at which the first head unit undergoes the maintenance by the maintenance unit, and a fifth position at which the first head unit is separated from the support unit and the maintenance unit.

4. The image recording device according to claim 3, wherein when the first head unit held in the unit holder is positioned at the fifth position, the second position is a position that does not overlap the support unit and the maintenance unit.

5. The image recording device according to claim 1, further comprising a coupling member having a connecting part, a first hinge coupling the unit holder and the connecting part, and a second hinge coupling the connecting part and the member.

6. The image recording device according to claim 1, wherein the member is a liquid supply system configured to supply the liquid to the first head unit, and the member is constituted movable relative to the unit holder.

7. An image recording device, comprising:

a first head unit configured to discharge a liquid;

a unit holder detachably holding the first head unit;

a member configured to move relative to the unit holder; and a second head unit configured to discharge a liquid, the second head unit being held detachably with the unit holder, wherein when a trajectory through which the first head unit passes when the first head unit is attached or detached with the unit holder is used as a first trajectory, the member is configured to move between a first position at which the member is positioned relative to the unit holder so as to overlap the first trajectory, and a second position at which the member is positioned relative to the unit holder so as to be separated from the first trajectory, and when the member is in the first position, the member is separated from a second trajectory through which the second head unit passes when the second head unit is attached or detached with the unit holder, and when the member is in the second position, the member overlaps the second trajectory.

8. The image recording device according to claim 7, further comprising a coupling member fixed to the member and the unit holder, the coupling member coupling the member and the unit holder such that the member moves relative to the unit holder.

9. The image recording device according to claim 8, further comprising a support unit configured to support a recording medium, and a maintenance unit configured to implement maintenance on the first head unit, wherein the unit holder is configured to move together with the member between a third position at which the first head unit discharges the liquid on the recording medium supported on the support unit, a fourth position at which the first head unit undergoes the maintenance by the maintenance unit, and a fifth position at which the first head unit is separated from the support unit and the maintenance unit.

10. The image recording device according to claim 9, wherein when the first head unit held in the unit holder is positioned at the fifth position, the second position is a position that does not overlap the support unit and the maintenance unit.

11. The image recording device according to claim 7, further comprising a coupling member having a connecting part, a first hinge coupling the unit holder and the connecting part, and a second hinge coupling the connecting part and the member.

12. The image recording device according to claim 7, wherein the member is a liquid supply system configured to supply the liquid to the first head unit, and the member is constituted movable relative to the unit holder.

13. An image recording device, comprising a first head unit configured to discharge a liquid;

a unit holder detachably holding the first head unit;

a member coupled with the unit holder, the member being configured to move between a first position and a second position; and a flexible member that is flexible and fluidly connects the member with the first head unit, when the member is positioned at the first position, the first head unit being configured not to be attached or detached to the unit holder, and when the member is positioned at the second position, the first head unit being configured to be attached or detached to the unit holder.

14. The image recording device according to claim 13, further comprising a coupling member fixed to the member and the unit holder, the coupling member coupling the member and the unit holder such that the member moves relative to the unit holder.

15. The image recording device according to claim 14, further comprising a support unit configured to support a recording medium, and a maintenance unit configured to implement maintenance on the first head unit, wherein the unit holder is configured to move together with the member between a third position at which the first head unit discharges the liquid on the recording medium supported on the support unit, a fourth position at which the first head unit undergoes the maintenance by the maintenance unit, and a fifth position at which the first head unit is separated from the support unit and the maintenance unit.

16. The image recording device according to claim 15, wherein when the first head unit held in the unit holder is positioned at the fifth position, the second position is a position that does not overlap the support unit and the maintenance unit.

17. The image recording device according to claim 13, further comprising a coupling member having a connecting part, a first hinge coupling the unit holder and the connecting part, and a second hinge coupling the connecting part and the member.

18. The image recording device according to claim 13, wherein the member is a liquid supply system configured to supply the liquid to the first head unit, and the member is constituted movable relative to the unit holder.

* * * * *